US008383331B2

(12) United States Patent
Nakamura et al.

(10) Patent No.: US 8,383,331 B2
(45) Date of Patent: Feb. 26, 2013

(54) SILVER HALIDE PHOTOGRAPHIC LIGHT-SENSITIVE MATERIAL FOR MOVIE

(75) Inventors: Hiroshige Nakamura, Minami-ashigara (JP); Kenichi Yamamoto, Minami-ashigara (JP); Kazuhito Miyake, Minami-ashigara (JP); Hidekazu Sakai, Minami-ashigara (JP); Shigeru Shibayama, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/098,600

(22) Filed: May 2, 2011

(65) Prior Publication Data

US 2011/0275021 A1 Nov. 10, 2011

(30) Foreign Application Priority Data

May 7, 2010 (JP) ..... 2010-107762

(51) Int. Cl.

| | |
|---|---|
| ***G03C 1/76*** | (2006.01) |
| ***G03C 1/815*** | (2006.01) |
| ***G03C 1/825*** | (2006.01) |
| ***G03C 1/00*** | (2006.01) |
| ***G03C 3/00*** | (2006.01) |

(52) U.S. Cl. ..... 430/523; 430/496; 430/502; 430/510; 430/524; 430/525; 430/531; 430/536; 430/537; 430/934; 430/495.1

(58) Field of Classification Search ..... 430/523–525, 430/495.1, 496, 502, 510, 531, 536, 537, 430/934

See application file for complete search history.

(56) References Cited

U.S. PATENT DOCUMENTS

| | | | | |
|---|---|---|---|---|
| 4,775,605 | A | 10/1988 | Seki et al. | |
| 5,202,193 | A | 4/1993 | Sumi et al. | |
| 5,240,777 | A | 8/1993 | Wacher | |
| 6,551,769 | B2 * | 4/2003 | Viaene et al. | 430/522 |
| 7,422,843 | B2 * | 9/2008 | Soejima et al. | 430/502 |
| 2002/0123013 | A1 | 9/2002 | Viaene et al. | |
| 2007/0248906 | A1 | 10/2007 | Seojima et al. | |

FOREIGN PATENT DOCUMENTS

| | | | |
|---|---|---|---|
| EP | 0367573 | A1 | 5/1990 |
| EP | 1065563 | A1 | 1/2001 |
| GB | 1 318 263 | | 5/1973 |
| GB | 2 218 821 | A | 11/1989 |
| JP | 2002-311536 | A | 10/2002 |
| JP | 2007-264031 | A | 10/2007 |

OTHER PUBLICATIONS

Office Action issued on Nov. 9, 2012 from the European Patent Office in a counterpart European Application No. 11 164 412.6.

* cited by examiner

*Primary Examiner* — Geraldina Visconti
(74) *Attorney, Agent, or Firm* — Sughrue Mion, PLLC

(57) ABSTRACT

A silver halide photographic light-sensitive material for movie, having a specific layer structure by using particles of at least one kind of electroconductive metal oxide and at least one kind of an electroconductive polymer.

14 Claims, No Drawings

SILVER HALIDE PHOTOGRAPHIC LIGHT-SENSITIVE MATERIAL FOR MOVIE

FIELD OF THE INVENTION

The present invention relates to a silver halide photographic light-sensitive material for movie, and in particular it relates to a silver halide photographic light-sensitive material for movie, the silver halide photographic light-sensitive material excellent in reduction of electrostatic charge at the user use.

BACKGROUND OF THE INVENTION

The silver halide photographic light-sensitive material for movie is generally produced by forming a light-sensitive silver halide photographic emulsion layer (silver halide photographic light-sensitive layer), an antihalation layer, an interlayer, an undercoating layer, and the like on a transparent support (hereinafter, sometimes referred to as "a substrate") such as electrically-insulating plastic film.

In recent years, remarkable progress has been made in techniques to produce silver halide photographic light-sensitive materials, and production of print at higher speed is getting popular. With the speeding up, generation and accumulation of electrostatic charge in each production step raises many problems on these products and use thereof. For example, if an accumulated charge is discharged, a fog pattern is caused on an emulsion coated. With respect to materials such as movie films that are projected on a screen, a charge on the film during a movie accelerates adsorption of dust and dirt in air, which are resultantly displayed on a screen. A lot of problems caused by the charge have been dissolved by introduction of an undercoating layer having a low-electrical resistivity (an electrically-conductive layer) into a silver halide light-sensitive material (for example, refer to JP-A-2007-264031 ("JP-A" means unexamined published Japanese patent application)).

In recent years, however, it has become clear that use of an electrically-conductive layer having a low-electrical resistivity in a light-sensitive material raises another electrostatic problem after processing. In the case in which a charge on a surface of the other side of an electroconductive layer was generated by surface contact with parts of manufacturing equipments such as rollers, the electrically-conductive layer produces a charge with a polarity electrically opposite to the charge already generated, to cause electrical stabilization. As a result, an electric field is formed so as to be connected between an electrically conductive layer of the film and the other side of the electrically-conductive layer of a film. It has come to see that a rolled silver halide light-sensitive material like a movie film raises a film transfer trouble due to the cause that a distance between an electroconductive layer and a surface of the film lying next to each other is shorter (nearer) than a distance between an electrically-conductive layer and the other side sandwiching in a support, and two charges each having an opposite polarity electrically attract one another. The lower the electrical resistivity of the electroconductive layer, the more the transfer trouble becomes conspicuous. As a result, the film transfer trouble raises a lot of problems such as shutdown of an equipment and breakage of the equipment.

In order to address the above problems, a method of incorporating an electroconductive polymer in an electroconductive layer, thereby effecting a change in an electrical resistivity of the electrically-conductive layer before processing and an electrical resistivity of the electrically-conductive layer after processing is disclosed (for example, refer to JP-A-2002-311536).

With the speeding up of the print speed due to improvement of production, it is becoming popular to use a high-activated color developing bath to shorten a color developing time, thereby performing a processing in a short time without changing a color optical density. However, it has come to see that the electroconductive layer containing such electrically-conductive polymer shows a large change in electrical resistivity when a color developing time is changed.

As described above, a high-electrical resistivity of the electrically-conductive layer accelerates adsorption of dust and dirt, whereas a low-electrical resistivity of the electroconductive layer raises a film transfer problem. Accordingly, it is necessary to control electrical resistivity of the electrically-conductive layer of a film after processing.

SUMMARY OF THE INVENTION

The present invention resides in a silver halide photographic light-sensitive material for movie, comprising:

a transmissive support:

at least one silver halide emulsion layer;

at least one undercoating layer provided between the support and the silver halide emulsion layer closest to the support; and at least one undercoating layer and a protective layer provided at the back side of the support (namely, at the other side of the support which is opposite to the side at which the silver halide emulsion layer is provided), wherein any of the layers selected from the at least one undercoating layer at the side of silver halide emulsion layer, said at least one undercoating layer at the back side of the support and the protective layer at the back side of the support contains either or both of (a) particles of at least one kind of an electrically-conductive metal oxide and (b) at least one kind of an electroconductive polymer, and wherein, (i) the layer containing said particles of at least one kind of an electroconductive metal oxide is different from the layer containing said at least one kind of the electroconductive polymer, or (ii) said particles of at least one kind of an electroconductive metal oxide and said at least one kind of an electroconductive polymer are contained in the same layer other than the undercoating layer that is contacted with the back side of the support.

Other and further features and advantages of the invention will appear more fully from the following description.

DETAILED DESCRIPTION OF THE INVENTION

According to the present invention, there is provided the following means:

(1) A silver halide photographic light-sensitive material for movie, comprising:

a transmissive support:

at least one silver halide emulsion layer;

at least one undercoating layer provided between the support and the silver halide emulsion layer closest to the support; and at least one undercoating layer and a protective layer provided at the back side of the support (namely, at the other side of the support which is opposite to the side at which the silver halide emulsion layer is provided), wherein any of the layers selected from the at least one undercoating layer at the side of silver halide emulsion layer, said at least one undercoating layer at the back side of the support and the protective layer at the back side of the support contains either or both of (a) particles of at least one kind of an electrically-conductive metal oxide and (b) at least one kind of an electroconductive polymer, and wherein, (i) the layer containing said particles of at least one kind of an electroconductive metal oxide is different from the layer containing said at least one kind of the electroconductive polymer, or (ii) said particles of at least one kind of an electroconductive metal oxide and said at least one kind of an electroconductive polymer are contained in the same layer other than the undercoating layer that is contacted with the back side of the support.

(2) The silver halide photographic light-sensitive material for movie as described in the above item (I), wherein, (i) said particles of at least one kind of an electroconductive metal oxide and said at least one kind of an electrically-conductive polymer are contained, respectively, in different layers selected from said at least one undercoating layer at the back side of the support and the protective layer at the back side of the support, or (ii) one of (a) said particles of at least one kind of an electroconductive metal oxide and (b) said at least one kind of an electroconductive polymer is contained in said at least one undercoating layer at the side having the silver halide emulsion layer and the other of (a) said particles of at least one kind of an electroconductive metal oxide and (b) said at least one kind of an electroconductive polymer is contained in said at least one undercoating layer at the back side of the support or the protective layer at the back side of the support.

(3) The silver halide photographic light-sensitive material for movie as described in the above item (1), wherein said particles of at least one of an electroconductive metal oxide and said at least one kind of an electroconductive polymer are contained in different layers selected from said at least one undercoating layer at the back side of the support and the protective layer at the back side of the support.

(4) The silver halide photographic light-sensitive material for movie as described in any one of the above items (1) to (3), wherein said at least one kind of an electroconductive polymer is an electroconductive polymer selected from the group consisting of polythiophene, polyaniline, polypyrrole, and a complex thereof.

(5) The silver halide photographic light-sensitive material for movie as described in any one of the above items (1) to (4), wherein said particles of at least one kind of an electroconductive metal oxide is an oxide metal selected from the group consisting of ZnO, $TiO_2$, $SnO_2$, $Al_2O_3$, $In_2O_3$, MgO, a complex metal oxide of these metal oxides, and a metal oxide containing at least one kind of these metal oxides and a different atom.

(6) The silver halide photographic light-sensitive material for movie as described in any one of the above items (1) to (5), wherein a total amount of metal ions consisting of $Na^+$, $K^+$, $Ca^{2+}$ and $Mg^{2+}$ contained in all of the undercoating layer and the protective layer at the side of the support at which the layer containing the electroconductive polymer is provided is 0.5 $mg/m^2$ or less.

(7) The silver halide photographic light-sensitive material for movie as described in any one of the above items (1) to (6), wherein a total film thickness of said at least one undercoating layer at the back side of the support and the protective layer at the back side of the support is in a range from 0.02 μm to 1 μm.

(8) The silver halide photographic light-sensitive material for movie as described in any one of the above items (1) to (7), wherein the silver halide photographic light-sensitive material for movie has at least one yellow color-developable light-sensitive silver halide emulsion layer, at least one cyan color-developable light-sensitive silver halide emulsion layer, and at least one magenta color-developable light-sensitive silver halide emulsion layer on or above the support, and wherein the support is a polyester support.

(9) The silver halide photographic light-sensitive material for movie as described in any one of the above items (1) to (8), wherein electrical resistivities before and after processing of the silver halide photographic light-sensitive material for movie satisfy the relations of the following Expression (A) and Expression (B) at the same time:

$$SR1<9.0 \quad \text{Expression (A)}$$

$$9.5 \leqq SR \leqq 10.5 \quad \text{Expression (B)}$$

wherein, in Expression (A) and Expression (B), SR1 represents a common logarithm of electrical resistivity of the layer having the lowest electrical resistivity among layers containing said particles of at least one kind of an electroconductive metal oxide or said at least one electroconductive polymer before a processing of the silver halide photographic light-sensitive material for movie; and SR2 represents a common logarithm of electrical resistivity of the layer having the lowest electrical resistivity among layers containing said particles of at least one kind of an electroconductive metal oxide or said at least one electroconductive polymer after subjecting the silver halide photographic light-sensitive material for movie to a processing in which a processing time at the step of color development is set to be 3 minutes.

(10) The silver halide photographic light-sensitive material for movie as described in any one of the above items (1) to (9), wherein the common logarithms of the electrical resistivity of the silver halide photographic light-sensitive material for movie satisfy the relation of the following Expression (C):

$$|SR3-SR2| \leqq 0.3 \quad \text{Expression (C)}$$

wherein, in Expression (C), SR2 has the same meaning as that of SR2 defined in the above item (9); and SR3 represents a common logarithm of electrical resistivity of the layer having the lowest electrical resistivity among layers containing said particles of at least one kind of an electroconductive metal oxide or said at least one electroconductive polymer after subjecting the silver halide photographic light-sensitive material for movie to a processing in which a processing time at the step of color development is set to be 1 minute.

The silver halide photographic light-sensitive material for movie according to the present invention (hereinafter, also referred to simply as "a silver halide photographic light-sensitive material") has a transmission support and at least one silver halide emulsion layer provided above the support; and at least one undercoating layer provided between the support and the silver halide emulsion layer closest to the support; and further at least one undercoating layer and a protective layer each provided at the back side of the support (namely, at the other side of the support with respective to the side where the silver halide emulsion layer(s) are provided), wherein any of the layers selected from said at least one undercoating layer at the silver halide emulsion layer side, said at least one undercoating layer at the back side of the support and the protective layer at the back side of the support contains either or both of (a) particles of at least one kind of electroconductive metal oxide and (b) at least one electroconductive polymer, and the material satisfies (i) or (ii) wherein (i) the layer containing the electroconductive metal oxide particles and the layer containing the electroconductive polymer are different from each other, or (ii) the electroconductive metal oxide particles and the electroconductive polymer are contained in the same layer other than the undercoating layer that is in contact with the back side of the support.

In the present specification, the phrase "the silver halide emulsion layer side" or "the side of silver halide emulsion layer" refers to the side of the support where the silver halide emulsion layer(s) are provided, while "the back side" refers to the other side of the support where no silver halide emulsion layer(s) are provided.

—Undercoating Layer—

The undercoating layer for use in the present invention is described below.

Both sides of a support in the present invention each have at least one undercoating layer.

Specifically, at least one undercoating layer is provided between the support and the silver halide emulsion layer closest to the support; and further at least one undercoating layer is provided at the back side of the support (namely, at the other side of the support with respective to the side where the silver halide emulsion layer is provided). In the present invention, the undercoating layer may be a single layer or a multilayer including two or more layers. Preferably, at least two undercoating layers are provided between the support and the silver halide emulsion layer closest to the support. Further, one undercoating layer is preferably provided at the back side of the support, and more preferably a protective layer is provided on the undercoating layer.

(Binder)

Generally, it is preferred that the undercoating layer contains a binder in order to immobilize various dispersion and particles described below. Examples of the binder include various polymers such as acrylic resin, vinyl resin, polyurethane resin, and polyester resin. From the standpoint of preventing white-powder contamination, a hardened material formed of a polymer (preferably, acrylic resin, vinyl resin, polyurethane resin or polyester resin) and a cross-liking agent is preferably used.

Particularly, from the standpoint of maintaining a satisfactory working environment and preventing air pollution, hardened materials produced from a water-soluble or water-dispersed (e.g. emulsion) polymer and a cross-linking agent are preferable. Further, the above-described polymer preferably has any one of a methylol group, a hydroxyl group, a carboxyl group, and a glycidyl group, so as to allow crosslinking reaction with a cross-linking agent, such as a carbodiimide compound. Among these groups, a hydroxyl group and a carboxyl group are more preferable, and a carboxyl group is particularly preferable. An amount of the group (preferably, a hydroxyl group or a carboxyl group) existing in the polymer is preferably 0.0001 to 1 equivalent/1 kg, and particularly preferably 0.001 to 1 equivalent/1 kg.

Examples of the acrylic resins may include homopolymers of any one monomer of acrylic acid, acrylic acid esters, such as alkyl acrylates; acrylamides; acrylonitriles, methacrylic acid; methacrylic acid esters, such as alkyl methacrylates; methacrylamides and methacrylonitriles, and copolymers obtained by polymerizing two or more of these monomers. Among these polymers or copolymers, homopolymers of any one monomer of acrylic acid esters, such as alkyl acrylates, and methacrylic acid esters, such as alkyl methacrylates, or copolymers obtained by polymerization of two or more of these monomers, are preferable. Examples of these homopolymers or copolymers may include homopolymers of any one monomer of acrylic acid esters and methacrylic acid esters having an alkyl group having 1 to 6 carbon atoms, or copolymers obtained by the polymerization of two or more of these monomers.

The above acrylic resin is preferably a polymer obtained by using the above composition as its major component and by partially using a monomer having any group of, for example, methylol group, hydroxyl group, carboxyl group, and glycidyl group, so as to enable a crosslinking reaction with the cross-linking agent, such as a carbodiimide compound.

Preferable examples of the above vinyl resin include polyvinyl alcohol, acid-modified polyvinyl alcohol, polyvinyl formal, polyvinyl butyral, polyvinyl methylether, polyolefin, ethylene/butadiene copolymer, polyvinyl acetate, vinyl chloride/vinyl acetate copolymer, vinyl chloride/(meth)acrylic acid ester copolymer, and ethylene/vinyl acetate-series copolymer (preferably an ethylene/vinyl acetate/(meth) acrylic acid ester copolymer). Among these, polyvinyl alcohol, acid-modified polyvinyl alcohol, polyvinyl formal, polyolefin, ethylene/butadiene copolymer, and ethylene/vinyl acetate-series copolymer (preferably an ethylene/vinyl acetate/acrylic acid ester copolymer) are preferable.

In order for the above vinyl resin to be able to crosslink with the cross-linking agent such as a carbodiimide compound, it is preferable that the polyvinyl alcohol, acid-modified polyvinyl alcohol, polyvinyl formal, polyvinyl butyral, polyvinyl methylether, and polyvinyl acetate are respectively formed as a polymer having a hydroxyl group by, for example, leaving a vinyl alcohol unit in the polymer; and that the other polymers are respectively formed as a cross linkable polymer by, for example, partially using a monomer having any one group of a methylol group, hydroxyl group, carboxyl group and glycidyl group.

Examples of the above polyurethane resin may include polyurethanes derived from any one of a polyhydroxy compound (e.g., ethylene glycol, propylene glycol, glycerol, and trimethylol propane), an aliphatic polyester-series polyol obtained by a reaction between a polyhydroxy compound and a polybasic acid; a polyether polyol (e.g., poly(oxypropylene ether)polyol, poly(oxyethylene-propylene ether)polyol), a polycarbonate-series polyol, a polyethylene terephthalate polyol, and a mixture of the above with a polyisocyanate. In the case of the above polyurethane resin, for instance, a hydroxyl group that is left unreacted after the reaction between the polyol and the polyisocyanate is completed, may be utilized as a functional group which can run a reaction with the cross-linking agent, such as carbodiimide compound.

As the above polyester resin, use can be made of polymers obtained by a reaction between a polyhydroxy compound (e.g., ethylene glycol, propylene glycol, glycerol, and trimethylolpropane) and a polybasic acid. In the case of the above polyester resin, for instance, a hydroxyl group or carboxyl group that is left unreacted after the reaction between the polyol and the polybasic acid is completed, may be utilized as a functional group which can run a reaction with the cross-linking agent, such as carbodiimide compound. Of course, a third component having a functional group such as a hydroxyl group may be added.

Among the above polymers, acrylic resins and polyurethane resins are preferable and acrylic resins are particularly preferable.

These resins have a good reactivity with a carbodiimide compound in particular. By using these in combination, a good curing reaction is achieved. Accordingly, these resins have excellent properties in terms of drying temperature and drying time at the time of film formation (at the time of cross-link) described below. For example, a film having a sufficient film strength can be formed without heating at a high temperature that may adversely affect a support. Further, it is possible to realize a film formation by drying in a short time using a quick-drying property.

Here, details of the carbodiimide compound described above as a cross-linking agent are explained.

The carbodiimide compound can be used without any particular limitation, as long as it has a plurality of carbodiimide groups in the molecule. Such a polycarbodiimide compound is generally synthesized by a condensation reaction of an organic diisocyanate. In the present invention, as described above, it is preferred to use an aqueous coating liquid using a water-soluble polymer or a polymer that is in the state of aqueous dispersion as a binder for an undercoating layer. In a case in which a compound having a plurality of carbodiimide structures is incorporated in such an aqueous coating liquid, it is preferred to impart a hydrophilic property by reacting a compound having both a hydrophilic group and a functional group having reactivity with an isocyanate group, with respect to a terminal isocyanate group.

The organic moiety of the organic diisocyanate used for synthesizing the carbodiimide compound is not particularly limited, and may be an aromatic moiety, an aliphatic moiety, or a combination thereof. It is preferred from the viewpoint of reactivity that the organic moiety is aliphatic.

In the synthesis, an organic isocyanate, an organic diisocyanate, an organic triisocyanate, etc. is used as a starting material.

The organic isocyanate may be an aromatic isocyanate, an aliphatic isocyanate, or a mixture thereof.

Specific examples thereof include 4,4'-diphenylmethane diisocyanate, 4,4-diphenyldimethylmethane diisocyanate, 1,4-phenylene diisocyanate, 2,4-tolylene diisocyanate, 2,6-tolylene diisocyanate, hexamethylene diisocyanate, cyclohexane diisocyanate, xylylene diisocyanate, 2,2,4-trimethylhexamethylene diisocyanate, 4,4'-dicyclohexylmethane diisocyanate, and 1,3-phenylene diisocyanate. Examples of the organic monoisocyanates include isophorone isocyanate, phenyl isocyanate, cyclohexyl isocyanate, butyl isocyanate, and naphthyl isocyanate.

Specific examples of commercially available carbodiimide compounds usable in the present invention include CARBODILITE V-02-L2 (trade name, available from Nisshinbo Industries, Inc.).

The carbodiimido compound may be used in combination with another compound. Examples of the other compounds include hardening agents described in C. E. K. Meers and T. H. James, "The Theory of the Photographic Process", 3rd edition (1966), U.S. Pat. No. 3,316,095, U.S. Pat. No. 3,232,764, U.S. Pat. No. 3,288,775, U.S. Pat. No. 2,732,303, U.S. Pat. No. 3,635,718, U.S. Pat. No. 3,232,763, U.S. Pat. No. 2,732,316, U.S. Pat. No. 2,586,168, U.S. Pat. No. 3,103,437, U.S. Pat. No. 3,017,280, U.S. Pat. No. 2,983,611, U.S. Pat. No. 2,725,294, U.S. Pat. No. 2,725,295, U.S. Pat. No. 3,100,704, U.S. Pat. No. 3,091,537, U.S. Pat. No. 3,321,313, U.S. Pat. No. 3,543,292, U.S. Pat. No. 3,125,449, UK Patent No. 994869 and UK Patent No 1167207.

Typical examples of the hardening agents include aldehyde compounds such as mucochloric acid, mucobromic acid, mucophenoxychloric acid, mucophenoxybromic acid, formaldehyde, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran, and glutaric aldehyde, and derivatives thereof; active vinyl compounds such as divinylsulfone-N,N'-ethylene-bis(vinylsulfonylacetamide), 1,3-bis(vinylsulfonyl)-2-propanol, methylenebismaleimide, 5-acetyl-1,3-diacryloyl-hexahydro-s-triazine, 1,3,5-triacryloyl-hexahydro-s-triazine, and 1,3,5-trivinylsulfonyl-hexahydro-s-triazine; active halogen compounds such as 2,4-dichloro-6-hydroxy-s-triazine sodium salt, 2,4-dichloro-6-(4-sulfoanilino)-s-triazine sodium salt, 2,4-dichloro-6-(2-sulfoethylamino)-s-triazine, and N,N'-bis(2-chloroethylcarbamyl)piperazine; epoxy compounds such as bis(2,3-epoxypropyl)methylpropylammonium p-toluenesulfonate salt, 1,4-bis(2',3'-epoxypropyloxy)butane, 1,3,5-triglycidyl isocyanurate, 1,3-diglycidyl-5-(γ-acetoxy-β-oxypropyl)isocyanurate, sorbitol polyglycidyl ethers, polyglycerol polyglycidyl ethers, pentaerythritol polyglycidyl ethers, diglycerol polyglycidyl ethers, 1,3,5-triglycidyl (2-hydroxyethyl)isocyanurate, glycerol polyglycerol ethers, and trimethylolpropane polyglycidyl ethers; ethyleneimine compounds such as 2,4,6-triethylene-s-triazine, 1,6-hexamethylene-N,N'-bisethyleneurea, and bis-β-ethyleneiminoethyl thioether; methanesulfonate ester compounds such as 1,2-di(methanesulfonoxy)ethane, 1,4-di(methanesulfonoxy) butane, and 1,5-di(methanesulfonoxy)pentane; carbodiimide compounds such as dicyclohexylcarbodiimide and 1-dicyclohexyl-3-(3-trimethylaminopropyl)carbodiimide hydrochloride salt; isoxazole compounds such as 2,5-dimethylisoxazole; inorganic compounds such as chrome alum and chromium acetate; dehydration-condensation-type peptide reagents such as N-carboethoxy-2-isopropoxy-1,2-dihydroquinoline and N-(1-morpholinocarboxy)-4-methylpyridium chloride; active ester compounds such as N,N'-adipoyldioxydisuccinimide and N,N'-terephthaloyldioxydisuccinimide; isocyanate compounds such as toluene-2,4-diisocyanate and 1,6-hexamethylene diisocyanate; and epichlorohydrin compounds such as polyamide-polyamine-epichlorohydrin reaction products. However, the hardening agents are not limited to these.

The amount of the binder contained in the undercoating layer is preferably in a range from 5 to 100 mg/m$^2$, and more preferably in a range from 10 to 25 mg/m$^2$. If the amount is too small, sufficient film membrane strength may not be obtained. If the amount is too large, coagulation may be caused and stability of coating liquid may be impaired.

(Fine Particles)

As described above, the undercoating layer preferably contains fine particles serving as a matting agent. To contain the fine particles in the undercoating layer is preferred from the viewpoint of achieving conspicuous effects on both reduction of printing dust when used by users and improvement of transfer properties.

It may be necessary to set an addition amount of the fine particles in the range of from 2 mg/m$^2$ to 15 mg/m$^2$. Especially, from the viewpoints of both reduction of printing dusts and improvement of transparency, the addition amount of the fine particles is preferably from 2 mg/m$^2$ to 10 mg/m$^2$, more preferably from 2 mg/m$^2$ to 7 mg/m$^2$, and still more preferably from 2 mg/m$^2$ to 5 mg/m$^2$.

When the addition amount of the fine particles is too small, sometimes the printing dust-reduction effect may be lost. In contrast, when the addition amount of the fine particles is too large, a haze value may increase and sometimes transparency may be conspicuously deteriorated. Accordingly, it is preferred to set the addition amount in the range of from 2 mg/m$^2$ to 15 mg/m$^2$.

In the present invention, it may be necessary to set an average particle size of the fine particles in the range of from 0.2 to 0.5 μm. Especially, from the viewpoints of both drop-out of the fine particles and transparency, the average particle size of the fine particles is preferably from 0.2 to 0.4 μm.

However, the important point from the viewpoint of reduction in printing dusts is a surface unevenness (asperity). Accordingly, it is important how much the fine particles produce the asperity on the surface with respect to a total thickness of the all layers at the side having the undercoating layer containing the fine particles. For example, in a case in which a total thickness of all layers at the side of the undercoating layer is 0.1 μm, fine particles having an average particle size of from 0.2 to 0.4 μm are preferred.

When the average particle size is too small, asperity is not produced on the surface. As a result, a printing dust-reducing effect may not be produced. On the other hand, when the average particle size is too large, a surface configuration is formed in which fine particles protrude in a large way from the total thickness of all layers. As a result, sometimes the fine particles may be easily dropped out by an external friction. A layer thickness, though described in detail below, is preferably about 0.1 μm from the viewpoint of a coating property. Accordingly, the average particle size of the fine particles is preferably from 0.2 to 0.5 μm, become it enables to have a surface unevenness capable of reducing printing dusts with preventing the fine particles from drop-out.

The average particle size indicates the average of values measured with a magnifying glass after direct observation of the fine particles by a scanning electron microscope. Details of a measuring method are described below.

Preparation of sample: About 0.3 g of sample is weighed and placed in an about 20 ml-volume glass bottle, and about 5 ml of distilled water is added thereto and well shaken. In a case where the sample is already in a form of an aqueous dispersion, a concentration of the sample is adjusted to about 1% and then the sample is well shaken. Further, the sample is subjected to an ultrasonic treatment for 1 minute to sufficiently disperse the same. A drop of the resultant dispersion is put on an aluminum tape, then thinly-spread, and then dried naturally at ordinary temperature. After drying, a strip of about 5×5 mm is cut from the sample and then attached to a brass sample stage.

Sputtering: The sample stage is placed in the sputter equipment (for example, E-1030 (trade name), manufactured by Hitachi Ltd.) and sputtering is performed under the following conditions.

Target: Pt—Pd (density=19.5)

Film thickness: 10 nm

Photo shooting: The sputtered sample is set in a scanning electron microscope (for example, S-800 (trade name), manufactured by Hitachi Ltd.) and photo shoot is done with a Polaroid camera.

Conditions of photo shooting: (a) Accelerating voltage: 25 kv, (b) Magnification: 10000 times, (c) Angle of sample stage: horizontal Measurement of particle size: (a) the photographed picture is placed with setting the listed number to the right side, and a diameter of spherical and distinct particles existing near the center of the picture is read through a 10-time magnifying glass to an accuracy of 1/10 mm in a transverse direction. Diameters of 10 particles are each read and the average of these diameters is calculated. (b) With respect to a standard sample of polyvinyl toluene particles (a product of Dow Chemical Company, 0.399 μm) photographed at the same time as the above samples, measurement of particle size is performed in the same manner as in above (a) to obtain a correction factor. (c) The average obtained in the above (a) and further multiplied by the correction factor is defined as an average diameter of the sample.

The fine particles for use in the present invention are not particularly limited and organic fine particles and/or inorganic fine particles may be used.

Examples of the organic fine particles include fine particles of polymer such as polymethyl methacrylate (PMMA), polystyrene, polyethylene, and polypropylene; fine particles of other radical polymerization-system polymers; and fine particles of condensation polymers such as polyesters and polycarbonates. Among these polymers, polymethyl methacrylate (PMMA), polystyrene, polyethylene, and polypropylene are preferred, and polymethyl methacrylate (PMMA) and polystyrene are more preferred.

The fine particles capable of serving as the above-mentioned matting agent can be prepared by emulsion polymerization or by dispersing already-produced polymers with a sand mill or the like, thereby microparticulating polymers.

The shape of the fine particles is preferably spherical, and more preferably pearly-shaped.

Examples of the inorganic fine particles include fine particles of zinc oxide, titanium oxide, barium sulfate, calcium carbonate, silica, alumina powder, and magnesium carbonate.

In the present invention, the fine particles may be used singly, or in combination of two or more kinds thereof (Other Components)

The above-described undercoating layer may, if necessary, also include other components such as a surface active agent, and a lubricating agent so long as the effects of the present invention may not be damaged.

Examples of the above-described surface active agent include known anion-based surface active agents, cation-based surface active agents, ampholytic surface active agents, and non-ionic surface active agents.

Examples of the lubricating agent include phosphoric ester of higher alcohol having 8 to 22 carbon atoms, or amino salt thereof; palmitic acid, stearic acid, behenic acid, and esters thereof; silicone-based compound; and carnauba wax.

—Electroconductive Layer—

In the present invention, among undercoating layers and a protective layer at the back side of the support, a layer containing an electroconductive polymer and/or electroconductive metal oxide particles is defined as an electroconductive layer.

(Electroconductive Polymer)

As for the above-described electroconductive polymers, at least one electroconductive-conjugated system polymer selected from polythiophene, polyaniline, polypyrrole, and derivatives of these polymers, and electroconductive-conjugated system polymers doped with at least one dopant selected from polystyrene sulfonic acid, toluene sulfonic acid, sulfonic acid, and sulfuric acid are preferred. Among these polymers, 3,4-dialkoxypolythiophene/polystyrene sulfonic acid is preferred. Especially, poly(3,4-ethylenedioxythiophene)/poly(styrene sulfonic acid) is preferred. This product is sold by Agfa-Gevaert in the trademark of Orgacon and also by H. C. Starck GmbH in the trademark of CLEVIOUS.

The content of the electroconductive polymer in an electroconductive layer is preferably in the range of from 0.1 $mg/m^2$ to 10 $mg/m^2$, and more preferably from 0.1 $mg/m^2$ to 5 $mg/m^2$, from the viewpoint of charge control. When the content is too small, a sufficient antistatic property may not be obtained and resultantly problems such as static mark may be caused. On the other hand, when the content is too large, a transfer failure during protection as described above may be caused.

(Electroconductive Metal Oxide Particles)

From the viewpoint of the transparency, film strength, and antistatic property of the film, the electroconductive metal oxide particles are preferably needle-form metal oxide particles, and the metal oxide is a metal oxide selected from the group consisting of ZnO, $TiO_2$, $SnO_2$, $Al_2O_3$, $In_2O_3$, MgO, complex metal oxides of these metal oxides, and metal oxides containing at least one of these metal oxides and a different atom. Of these, $SnO_2$, ZnO, $In_2O_3$ and $TiO_2$ are preferable, and $SnO_2$ is more preferable.

Example of the metal oxide containing a small amount of a different atom may include those obtained by doping ZnO with a small amount of Al or In, $TiO_2$ with a small amount of Nb or Ta, $In_2O_3$ with a small amount of Sn, and $SnO_2$ with a small amount of Sb, Nb, or a halogen atom.

The dope amount of the different atom with which the metal oxide is doped is preferably from 0.01 to 30 mol %, more preferably from 0.1 to 10 mol %.

If the dope amount of the different atom is too small, sufficient electroconductivity may not be imparted to the oxide or complex oxide. If the dope amount is too large, the blackening of the metal oxide particles themselves is increased, leading to the formation of a blackish antistatic layer. As a result, these particles in an amount out of the above ranges are unsuitable for the silver halide photographic light-sensitive material in some cases.

Those having an oxygen defect in their respective crystal structure are also preferable. Among the above-mentioned metal oxide particles containing a small amount of a different atom, $SnO_2$ particles doped with antimony is preferred, and $SnO_2$ particles doped with 0.2 to 2.0 mol % of antimony is more preferred.

As the size of the electroconductive metal oxide particles, the ratio of the long axis length to the short axis length (the long-axis/short-axis ratio) is preferably from 3 to 50.

The short axis length of the electroconductive metal oxide particles is preferably from 0.001 to 0.1 μm.

The content of the metal oxide particles in the electroconductive layer is preferably from 2 $mg/m^2$ to 2000 $mg/m^2$, more preferably from 50 $mg/m^2$ to 1000 $mg/m^2$, and particularly preferably from 50 $mg/m^2$ to 500 $mg/m^2$ from the viewpoint of antistatic property and transparency. If the content is too little, sufficient antistatic performance may not be obtained. If the content is too large, the haze value may become high so that the transparency may remarkably deteriorate. It is allowable to use, as an antistatic agent, a known antistatic agent which can be used in a silver halide photographic light-sensitive layer described below, together with the above-described needle-form metal oxide particles.

In addition, a preferable embodiment of the undercoating layer at the silver halide emulsion layer side is separately described below.

—Protective Layer—

In the present invention, among undercoating layers, an outermost layer that is a layer mainly provided in order to improve both slipping property and scratch resistance is defined as a protective layer. In the present invention, it is preferred to use the above-described electroconductive metal oxide particles and electroconductive polymer in a protective layer at the back side of the support, thereby forming an electroconductive layer which resultantly imparted with both functions.

The binding agent, the cross-linking agent, the fine particles (matting agent), the surfactant, and the slipping agent, all of which are described with respect to the above-described undercoating layer, are preferably applied to the protective layer. Preferable ranges of these materials are the same as those described with respect to the undercoating layer.

In addition, polyolefin is preferable as a binding agent for a protective layer. Examples of the polyolefin include (1) waxes, resins and rubber-like products, comprising homopolymers or copolymers of 1-olefin-series unsaturated hydrocarbons, such as ethylene, propylene, 1-butene, and 4-methyl-1-pentene (e.g., polyethylene, polypropylene, poly-1-butene, poly-4-methyl-1-pentene, ethylene/propylene copolymer, ethylene/1-butene copolymer, and propylene/1-butene copolymer), (2) rubber-like copolymers of two or more types of the above 1-olefin and a conjugated or non-conjugated diene (e.g., an ethylene/propylene/ethylidene norbornane copolymer, ethylene/propylene/1,5-hexadiene copolymer, and isobutene/isoprene copolymer), (3) copolymers of the above 1-olefin and a conjugated or non-conjugated diene (e.g., an ethylene/butadiene copolymer and ethylene/ethylidene norbornane copolymer), (4) copolymers of the above 1-olefin, particularly ethylene, and a vinyl acetate, and completely or partly saponified products of these copolymers, and (5) graft polymers obtained by grafting the above conjugated or non-conjugated diene or vinyl acetate on a homopolymer or copolymer of the above 1-olefin, and completely or partly saponified products of these graft polymers. However, the binding agents are not limited to these compounds. The aforementioned compounds are described in JP-B-5-41656 ("JP-B" means examined Japanese patent publication).

Among the aforementioned polyolefins, those having a carboxyl group and/or a carboxylate group are preferable. These polyolefins are generally used in the form of an aqueous solution or a water dispersion liquid. The amount of the polyolefin to be coated is preferably in a range from 10 to 50 $mg/m^2$, and more preferably in a range from 20 to 35 $mg/m^2$. If the amount of coating is too small, scratch resistance may not be sufficiently improved. If the amount of coating is too large, coating unevenness or liquid repellency may occur frequently.

(Other Components)

In addition to the above-described components, other components mentioned for the undercoating layer (i.e., a matting agent, a surface active agent, a lubricating agent and the like) may also be used together, as occasion demands, in the protective layer.

The thickness of the above protective layer is preferably 0.01 to 1 and more preferably 0.01 to 0.2 μm. When the thickness is too thin, coating nonuniformity of the product tends to be caused because it is hard to apply a coating material uniformly. When the thickness is too thick, inferior antistatic property and resistance to scratching can be caused sometimes.

Further, a total film thickness of the undercoating layer at the back side of the support and the protective layer at the back side of the support is preferably in the range of from 0.02 to 1 μm.

—Transparent Support (Substrate)—

The above-described transparent (transmissive) support is preferably a polyester film. Examples thereof include films of polyethylene terephthalate and polyethylene naphthalate. In addition, films of cellulose triacetate, cellulose acetate butylate, and cellulose acetate propionate are also preferable. The above-described polyester film may be used (a) before successive biaxial stretching, (b) before simultaneous biaxial stretching, (c) after uniaxial stretching and before re-stretching, or (d) after biaxial stretching.

Among the above-described films, a polyethylene terephthalate film is preferable, and a biaxially-stretched and thermally-fixed polyethylene terephthalate film is particularly preferable from the standpoint of stability and toughness.

The thickness of the polyester substrate is not particularly limited, and generally in a range from 15 to 500 μm. Particularly, the thickness is preferably in a range from 40 to 200 μm from the standpoint of handling characteristics and versatility. The substrate may contain dyeable silicon, alumina sol, chromium salt, zirconium salt or the like so long as the transparency thereof can be maintained.

Further, a surface of the substrate is preferably subjected in advance to a surface active treatment such as chemical treatment, mechanical treatment, corona discharge treatment, flame treatment, ultraviolet treatment, high-frequency treatment, glow discharge treatment, active plasma treatment, laser treatment, mixed acid treatment or ozone acid treatment, for the purpose of allowing secure adhesion of each undercoating layer to the surface of the substrate.

These surface treatments each are assumed to have the effects of: forming a polar group in some degree on the surface of the support, which is originally hydrophobic, removing a thin layer that gives an adverse effect on the adhesion of the surface, and increasing the crosslinking density of the surface, thereby increasing the adhesive force. As a result, it is assumed that, for example, the affinity of components contained in a solution for forming the undercoating layer to the polar group is increased and the fastness of the bonded surface is increased, thereby improving adhesion between the undercoating layer and the surface of the support.

The method of applying the undercoating layer at the side of the silver halide emulsion layer, is classified into the so-called multilayer method, wherein a layer sufficiently adhesive to the support (first undercoating layer) is formed as a first layer and then a gelatin layer (second undercoating layer) is formed on the first layer; and the so-called monolayer method, wherein only one resin layer containing both of a hydrophobic group and a hydrophilic group is applied. In order to form the undercoating layer, for example, a method is used, wherein two layers of undercoating layers comprised of a first undercoating layer containing high-molecular substance and a second undercoating layer containing gelatin, are formed by applying aqueous coating liquids (that is, a coating liquid for forming the first undercoating layer or the second undercoating layer).

Examples of the high-molecular substance for the first undercoating layer include any copolymer made of monomers, as a starting material, selected from vinyl chloride, vinylidene chloride, butadiene, methacrylic acid, acrylic acid, itaconic acid, maleic anhydride and others; polyethyleneimine, epoxy resin grafted gelatin, and nitrocellulose.

If desired, a swelling agent may be added to the first undercoating layer. Examples thereof include phenol and resorcin. The addition amount thereof is preferably from 1 to 10 g per liter of the coating solution for the first undercoating layer. In addition, hydrophilic polymer, blocking inhibitor, methylcellulose, polyvinyl alcohol, and the like may also be added to the first undercoating layer.

Examples of the hydrophilic polymer include natural polymers such as gelatin; and synthetic polymers such as polyvinyl alcohol, vinyl acetate/maleic anhydride copolymer, acrylic acid/acrylamide copolymer, and styrene/maleic anhydride copolymer. Examples of the blocking inhibitor include a mat agent such as silicon dioxide, polymethyl acrylate and polystyrene. Further, in both the first undercoating layer and the second undercoating layer, generally, a hardening agent such as dichlorotriazine derivatives or epoxy compound may be used.

The coating solution for the first undercoating layer can be coated by any one of generally well-known methods, such as a dip coating, an air-knife coating, a curtain coating, a roller coating, a wirebar coating, a gravure coating, and an extrusion coating using a hopper, as described in the specification of U.S. Pat. No. 2,681,294. Furthermore, in the case of applying the second undercoating layer onto the first undercoating layer, two layers or higher multilayers can be simultaneously coated by a method as described, for example, in the specifications of U.S. Pat. No. 2,761,791, U.S. Pat. No. 3,508,947, U.S. Pat. No. 2,941,898 and U.S. Pat. No. 3,526,528, and by Ozaki et al., in "Coating Technology (Coating Kogaku)" p. 253 (published by Asakura Shoten, 1973).

The coating amounts of the first undercoating layer and the second undercoating layer, in terms of solid components, are preferably from 0.01 to 10 g, more preferably from 0.2 to 3 g, per square meter of the polyester-film support. Generally a hydrophilic colloidal layer made mainly of gelatin is formed as the second undercoating layer on the first undercoating layer.

Examples of the hydrophilic polymer which is usable in the second undercoating layer other than gelatin include acylated gelatin (such as phthalic acid modified gelatin, and maleic acid modified gelatin), cellulose derivatives (such as carboxymethylcellulose, and hydroxyethylcellulose), a grafted gelatin wherein acrylic acid, methacrylic acid or amide is grafted to gelatin; polyvinyl alcohol, polyhydroxyalkyl acrylate, polyvinyl pyrrolidone, vinyl pyrrolidone/vinyl acetate copolymer, casein, agarose, albumin, sodium alginate, polysaccharide, agar, starch, grafted starch, polyacrylamide, polyethyleneimine acyl compound; a homopolymer or a copolymer made from acrylic acid, methacrylic acid, acrylamide, N-substituted acrylamide or N-substituted methacrylamide, and a partially hydrolyzed product thereof; and other synthetic or natural hydrophilic polymeric compounds. These may be used alone or as a mixture. If necessary, an antistatic agent, a crosslinking agent, a mat agent, a blocking inhibitor, or the like can be added to the hydrophilic polymer as described above.

—Coating Method—

The undercoating layer can be formed on the substrate, for example, in such a manner as described below.

First, the electroconductive metal oxide particles and/or electroconductive polymer as they are or in a state of a dispersed liquid in which the particles and/or polymer are dispersed in a solvent such as water (if necessary, containing a dispersant and a binder) are added to a water dispersed liquid or aqueous solution, which contains the above-described binder (for example, a polymer, a carbodiimide compound and appropriate additives) and mixed (if necessary, dispersed), thereby preparing a coating liquid for forming an undercoating layer (which may be hereinafter referred to as "coating liquid for undercoating layer").

The above-described coating liquid for undercoating layer is applied to the surface of a support (preferably a polyester support) by any of known coating methods and dried, thereby to form an undercoating layer.

Examples of the above-described known coating method include dip coating, air knife coating, curtain coating, wire bar coating, gravure coating, and extrusion coating.

The above-described plastic film such as polyester to be coated may be used before successive biaxial stretching, before simultaneous biaxial stretching, after uniaxial stretching and before re-stretching, or after biaxial stretching. It is preferred that the surface of a plastic support, on which a coating liquid for electroconductive layer is to be coated, is subjected to a surface treatment such as a ultraviolet treatment, a corona treatment, a glow discharge treatment, or the like in advance.

Since the coating film is an aqueous liquid film, it is advantageous to carry out drying after the coating in, for example, an atmosphere in which the maximum temperature during drying becomes 170° C. or higher, from the standpoint of drying speed and the like. In the case of using a carbodiimide compound as a cross-linking agent, from the viewpoint of film forming properties of the coated liquid film, adequate film strength can be achieved even though the maximum temperature in a drying time does not get to 170° C.

—Surface Electrical Resistivity—

In the present invention, the surface electrical resistivity (SR) is a value measured in accordance with a method described in the resistivity section of JIS-K-6911-1979.

—Processing—

The silver halide photographic light-sensitive material for movie according to the present invention can be processed standard processing steps using ECP-2D or ECP-2E Processing (this processing is described in Kodak Literature No. H-24: Kodak ECP-2D or ECP-2E process; and Manual for Processing EASTMAN Color Films). Conventional standard processing steps for a positive light-sensitive material for movie (except for a drying process)

(1) Color developing bath
(2) Stop bath
(3) Wash bath
(4) First fixing bath
(5) Wash bath
(6) Bleaching bath
(7) Wash bath
(8) Sound development (coating development)
(9) Rinse bath
(10) Second fixing bath
(11) Wash bath
(12) Stabilizing bath The standard ECP-2D processing is performed under the conditions shown in the following Table 1.

TABLE 1

| | Developing time | Developing temperature |
|---|---|---|
| (1) Color developing bath | 3 minutes | 36.7° C. |
| (2) Stop bath | 40 seconds | 27° C. |
| (3) Wash bath | 40 seconds | 27° C. |
| (4) First fixing bath | 40 seconds | 27° C. |
| (5) Wash bath | 40 seconds | 27° C. |
| (6) Bleaching bath | 1 minute | 27° C. |
| (7) Wash bath | 40 seconds | 27° C. |
| (8) Sound development | 10 to 20 seconds | 27° C. |
| (9) Rinse bath | 1 to 2 seconds | 27° C. |
| (10) Second fixing bath | 40 seconds | 27° C. |
| (11) Wash bath | 1 minute | 27° C. |
| (12) Stabilizing bath | 10 seconds | 27° C. |

An example of the conditions for a speed-up processing is shown in the following Table 2. According to this example, the developing time and the developing temperature of Color developing bath (1) of the ECP-2D processing were changed to conditions of one minute and 39° C., respectively.

TABLE 2

| | Developing time | Developing temperature |
|---|---|---|
| (1) Color developing bath | 1 minute | 39° C. |
| (2) Stop bath | 40 seconds | 27° C. |

TABLE 2-continued

| | Developing time | Developing temperature |
|---|---|---|
| (3) Wash bath | 40 seconds | 27° C. |
| (4) First fixing bath | 40 seconds | 27° C. |
| (5) Wash bath | 40 seconds | 27° C. |
| (6) Bleaching bath | 1 minute | 27° C. |
| (7) Wash bath | 40 seconds | 27° C. |
| (8) Sound development | 10 to 20 seconds | 27° C. |
| (9) Rinse bath | 1 to 2 seconds | 27° C. |
| (10) Second fixing bath | 40 seconds | 27° C. |
| (11) Wash bath | 1 minute | 27° C. |
| (12) Stabilizing bath | 10 seconds | 27° C. |

In addition, a drying step (13) is performed after the above-described stabilizing bath (12) in both cases.

In the present invention, with respect to the above-described processing steps, a common logarithm of electrical resistivity of the layer having the lowest electrical resistivity before processing steps is designated as SR1; and a common logarithm of electrical resistivity of the layer having the lowest electrical resistivity after the processing (the above-described steps of from (1) to (13)), in which a processing time at the step of color developing bath is 3 minutes and after passing through the drying step, is designated as SR2; and a common logarithm of electrical resistivity of the layer having the lowest electrical resistivity after the processing (the steps of from (1) to (13)), in which a processing time at the step of color developing bath is 1 minute and after passing through the drying step, is designated as SR3.

The silver halide photographic light-sensitive material for movie according to the present invention preferably satisfies both the following Expression (A) and the Expression (B) at the same time, or preferably satisfies the following Expression (C). The case where the silver halide photographic light-sensitive material satisfies the following Expression (A) to Expression (C) at the same time is most preferred.

$$SR1<9.0 \quad \text{Expression (A)}$$

$$9.5 \leqq SR2 \leqq 10.5 \quad \text{Expression (B)}$$

$$|SR3-SR2| \leqq 0.3 \quad \text{Expression (C)}$$

The value of SR1 is preferably less than 9.0; more preferably 8.7 or less; and further preferably 8.5 or less. The value of SR2 is preferably 9.5 or more and 10.5 or less; more preferably 9.7 or more and 10.5 or less; and further preferably 9.9 or more and 10.3 or less. The value of SR3 is preferably 9.5 or more and 10.5 or less; more preferably 9.7 or more and 10.5 or less; and further preferably 9.9 or more and 10.3 or less. The value of |SR3−SR2| is preferably 0.3 or less. In addition, measurement of the above values may be performed using samples having, on a support, only a single electroconductive layer to be measured for electrical resistance. Herein, the unit for the electrical resistivity is Ω/□ (ohms per square).

Next, an approach of an idea for preventing a trouble due to electrostatic charge is described herein. When a light-sensitive material is transported with a film projector or the like, static electricity is generated as described above so that the light-sensitive material may be electrified. It is known that the attenuation of the electrification voltage is represented by the following expression:

$$Vt=Vo\cdot\exp(-t/\tau)$$

wherein Vo represents the initial electrification voltage, Vt represents the voltage at the time t, and τ represents a time constant.

In the expression, $\tau$ can be expressed by CR wherein C represents the electrostatic capacity, and R represents the leakage current (=the electric resistance).

The matter that the time constant $\tau$ is small means that even if a large amount of electric charges is generated, the charges leak instantaneously so that the electrification quantity does not become large. It is therefore preferred that the electric resistance R is small in order to prevent the generation of a static mark in a light-sensitive material before the material is developed. In many of places where light-sensitive materials are handled before they are developed, temperature and humidity are controlled; thus, the property of the materials can be represented by the electric resistance thereof at a temperature of 25° C. and a relative humidity of 55%, which correspond to a typical condition.

However, it cannot be said that as the electric resistance is smaller, the resistance is more preferred. In the case that a light-sensitive material is in the state that the material is not electrostatically earthed, an electrostatic trouble is more easily caused as the resistance is smaller. For example, when a developed light-sensitive material is transported with a horizontal platter type film projector or the like, static electrification is generated by friction between the material and a roller at the center of the horizontal platter. In order to cancel electric charges based on the static electrification, electric charges having a reverse symbol are supplied to the charged portion from portions other than the charged portion. When the time constant of the material is small, this supply is instantaneously attained. The charge cannot escape to air under a low-humidity environment. In this circumstance, when a light-sensitive material is rewound again, an electrostatic attraction force arises between the rewound light-sensitive material and an adjacent rolled light-sensitive material, which results in causing a transport interruption.

In order to prevent this problem, it is preferred to make the electric resistance of a light-sensitive material somewhat large to make the time constant large, thereby making large the time necessary for canceling the static electricity generated by the friction between the material and the roller.

On the other hand, the electrical resistance after processing is made too high, an electrical static charge on the surface of the light-sensitive material is not canceled out and remains as it is. Resultantly, the light-sensitive material becomes easy to adsorb dust and dirt during transportation.

Accordingly, with respect to SR2, such a preferable range as defined by Expression (B) is specified.

—Shortening of Development Processing Time—

Next, shortening of color developing time is described.

According to the above-descried Manual for Processing EASTMAN Color Films, a standard color developing time is specified to be 3 minutes. However, the transportation velocity may be sometimes increased in order to increase a processing amount per unit time. Since the length of the color developing bath is limited, the color developing time is shortened. As described above, there is a preferable range for the value of electrical resistance after processing. Accordingly, it is not desirable that the value of electrical resistance changes depending on a color developing time.

Accordingly, it is preferred that a difference between SR3 (a common logarithm of electrical resistivity after passing through a 1-minute-color development step and all of the other processing steps) and SR2 (a common logarithm of electrical resistivity after passing through a 3-minute-color development step and all of the other processing steps) is as small as possible. A preferable range of the value of $|SR3-SR2|$ is 0.3 or less, and more preferably 0.15 or less.

—Film Thickness—

The silver halide photographic light-sensitive material for movie according to the present invention has at least the above-described electroconductive layer and protective layer, and further may have other layers. A total film thickness at the electroconductive layer side is preferably from 0.02 μm to 1 μm, and more preferably from 0.02 μm to 0.2 μm from the viewpoints of coating property, antistatic property, and scratch resistance.

If the layer thickness is too thin, it is difficult to uniformly apply the coating liquid, and coating unevenness is apt to occur. If the thickness is too thick, the antistatic ability and scratch resistance may be deteriorated.

—Amount of Metal Ion in Film—

In the present invention, a total mount (by mass) of metal ions consisting of $Na^+$, $K^+$, $Ca^{2+}$, and $Mg^{2+}$ contained in all of the undercoating layer and the protective layer provided on or above a support at the side of the support where a layer containing the above-described electroconductive polymer is provided, is preferably 0.5 mg/m$^2$ or less (from 0 to 0.5 mg/m$^2$). Herein, the phrase "all of the undercoating layer and the protective layer provided on or above a support at the side of the support where a layer containing the above-described conductive polymer is provided" refers to, for example, the following layers:

All undercoating layers (which include an undercoating layer containing no electroconductive polymer) at the silver halide emulsion layer side, in the case where the electroconductive polymer is contained in at least one of the undercoating layers at the silver halide emulsion layer side;

An undercoating layer(s) at the back side of the support and a protective layer at the back side of the support, in the case where an electroconductive polymer is contained in any one of the undercoating layer(s) at the back side of the support and the protective layer at the back side of the support; and All undercoating layers at the silver halide emulsion layer side and all undercoating layer(s) at the back side of the support and a protective layer at the back side of the support, in the case where an electroconductive polymer is contained in at least one of the undercoating layers at the silver halide emulsion layer side and any one of the undercoating layer(s) at the back side of the support and the protective layer at the back side of the support. Accordingly, a total of the above-described metal ions in these layers is regarded as the total amount of the metal ions.

The total amount of the metal ion is more preferably 0.3 mg/m$^2$ or less (from 0 to 0.3 mg/m$^2$). When the total amount is too large, electroconductive properties of the electroconductive metal oxides and the electroconductive polymers may be sometimes lost thereby.

—Position of Electroconductive Layer—

Next, a constitution of the electroconductive layer is described. A static charge that is generated by contact of the surface of a light-sensitive material with various members is oppositely charged to the polarity of a charge generated by the electroconductive layer. By canceling out these charges to each other, an electric field is closed so that prevention of static charge is achieved. Accordingly, the electroconductive layer may be provided to one side or another side of a transparent support, namely the silver halide photographic emulsion layer side or the other side thereof. In addition, the electroconductive layer may be incorporated in a silver halide photographic emulsion layer, an antihalation layer, a protective layer, an interlayer, or an undercoating layer; or in a transparent support. By using electroconductive metal oxide particles and an electroconductive polymer in the above-described layer, the layer can be concurrently serves as an electroconductive layer.

In the present invention, any one or more of the undercoating layer at the silver halide emulsion layer side, the undercoating layer at the back side of the support and the protective layer at the back side of the support is prepared so as to concurrently serves as an electroconductive layer. The case where the undercoating layer at the back side of the support and the protective layer at the back side of the support are prepared as electroconductive layers, and the case where at least one undercoating layer at the silver halide emulsion layer side and one of the undercoating layer at the back side of the support and the protective layer at the back side of the support are prepared as electroconductive layers are preferred. Of these cases, the case where the undercoating layer at the back side of the support and the protective layer at the back side of the support are prepared as electroconductive layers is more preferred. Further, the case where one of electroconductive metal oxide particles and an electroconductive polymer is contained in the undercoating layer at the back side of the support and the other of electroconductive metal oxide particles and an electroconductive polymer is contained in the protective layer at the back side of the support is still more preferred. Further, the case where electroconductive metal oxide particles are contained in the undercoating layer at the back side of the support and an electroconductive polymer is contained in the protective layer at the back side of the support is particularly preferred.

In addition, in the case where at least one undercoating layer at the silver halide emulsion layer side and the undercoating layer at the back side of the support or the protective layer at the back side of the support are prepared as electroconductive layers, the electroconductive layer at the silver halide emulsion layer side is preferably an undercoating layer in contact with the support (a first undercoating layer) and the electroconductive layer at the back side of the support is preferably the undercoating layer. In this case, it is more preferred to contain an electroconductive polymer in the undercoating layer at the back side of the support.

—Emulsion Layer—

(Silver Halide Emulsion Layer)

The silver halide photographic light-sensitive material for movie of the present invention has, on a support, at least one silver halide emulsion layer (hereinafter, also referred to as "photographic light-sensitive layer"). Regarding the silver halide emulsion layer, the silver halide photographic light-sensitive material for movie of the present invention is preferably a silver halide color photographic light-sensitive material for movie, which has at least one yellow-developable light-sensitive layer, at least one cyan-developable light-sensitive layer, and at least one magenta-developable light-sensitive layer. In the silver halide color photographic light-sensitive material for movie, it is especially preferred that in the following order nearer from a support, the yellow-developable light-sensitive layer, the cyan-developable light-sensitive layer and the magenta-developable light-sensitive layer are coated.

Further, the silver halide color photographic light-sensitive material for movie may have any of non-light-sensitive photographic constitutional layers such as an antihalation layer, an interlayer (color-mixing prevention layer), or a protective layer (protective layer at the silver halide emulsion layer side) in addition to the silver halide emulsion layer(s).

The above-described silver halide emulsion layer (and/or other photographic constitutional layers) may contain, as a binder, various hydrophilic colloids. Examples of the above-described hydrophilic colloids include gelatin, colloidal albumin, casein, cellulose derivatives such as calboxymethyl cellulose and hydroxyethyl cellulose; agar, alginate soda, sugar derivatives such as starch derivatives; synthetic hydrophilic colloid, for example, polyvinyl alcohol, poly N-vinylpyrolidone, polyacrylic acid copolymer, polyacrylamide, derivatives thereof, and partial hydrolytic sugar. A compatible mixture comprised of two or more kinds of these colloids may be used as occasion demands. Among these colloids, gelatin is generally used.

In the silver halide emulsion layer, a synthetic polymer compound, for example, a latex-form aqueous dispersion of vinyl compound polymer, particularly, a compound for increasing dimensional stability of photographic material may also be contained. The synthetic polymer may be contained singly or as a mixture of more than one different types of synthetic polymer compounds, or in combination with a water-permeable hydrophilic colloid. Examples of the above-described synthetic polymer compound are described in, for example, U.S. Pat. No. 2,376,005, U.S. Pat. No. 2,739,137, U.S. Pat. No. 2,853,457, U.S. Pat. No. 3,062,674, U.S. Pat. No. 3,411,911, U.S. Pat. No. 3,488,708, U.S. Pat. No. 3,525,620, U.S. Pat. No. 3,635,715, U.S. Pat. No. 3,607,290, U.S. Pat. No. 3,645,740, British Patent No. 1,186,699 and British Patent No. 1,307,373.

Among the compounds described above, copolymers and homopolymers prepared from a monomer(s) selected from the group consisting of alkylacrylate, alkylmethacrylate, acrylic acid, methacrylic acid, sulfoalkylacrylate, sulfoalkylmethacrylate, glycidyl acrylate, glycidyl methacrylate, hydroxyalkylacrylate, hydroxyalkylmethacrylate, alkoxyalkylacrylate, alkoxyalkylmethacrylate, styrene, butadiene, vinyl chloride, vinylidene chloride, maleic anhydrate and itaconic anhydrate are generally used.

The silver halide emulsion layer is subjected to hardening treatment by an ordinary method. Examples of a hardening agent used for the hardening treatment include aldehyde-based compounds such as formaldehyde and glutaraldehyde; ketone compounds such as diacetyl, cyclopentanedione; bis (2-chloroethyl urea); 2-hydroxy-4,6-dichloro-1,3,5-triazine; compounds having reactive halogen, described in U.S. Pat. No. 3,288,775, U.S. Pat. No. 2,732,303, British Patent No. 974,723 and British Patent No. 1,167,207; divinylsulfone; 5-acetyl-1,3-diacryloylhexahydro-1,3,5-triazine; compounds having reactive olefin, described in U.S. Pat. No. 3,635,718, U.S. Pat. No. 3,232,763, U.S. Pat. No. 3,490,911, U.S. Pat. No. 3,642,486, and British Patent No. 994,869; N-hydroxymethylphthalimide; N-methylol compounds described in U.S. Pat. No. 2,732,316 and U.S. Pat. No. 2,586,168; isocyanates described in U.S. Pat. No. 3,103,437 and the like; aziridine compounds described in U.S. Pat. No. 3,017,280 and U.S. Pat. No. 2,983,611; acid derivatives described in U.S. Pat. No. 2,725,294 and U.S. Pat. No. 2,725,295; carbodiimide-based compounds described in U.S. Pat. No. 3,100,704 and the like; epoxy compounds described in U.S. Pat. No. 3,091,537 and the like; isoxazole-based compounds described in U.S. Pat. No. 3,321,313 and U.S. Pat. No. 3,534,292; halogenocarboxyaldehydes such as mucochloric acid; dioxane derivatives such as dihydroxydioxane and dichlorodioxane, N-carbamoylpyridinium salts, and haloamidinium salts. Examples of an inorganic hardening agent include chrome alum and zirconium sulfate. In place of the above-described compounds, materials which are precursors, for example, alkali metal bisulfate aldehyde adduct, methylol derivative of hydantoin, and primary aliphatic nitroalcohol can also be used.

An emulsion for forming the silver halide emulsion layer (for example, a coating liquid for a silver halide light-sensitive layer) is generally prepared as a silver halide emulsion in such a manner that, a water-soluble silver salt (for example, silver nitrate) solution and a water-soluble halogen salt (for example, potassium bromide) solution are mixed together in the presence of a hydrophilic colloid (water-soluble polymer), e.g. gelatin, solution. In this case, as the silver halide, use can be made of silver chloride and silver bromide as well as mixed silver halides such as those further chlorinated or iodinated or silver chloroiodobromide.

The above-described silver halide emulsion may include various compounds added thereto, for the purpose of preventing decrease of sensitivity or occurrence of fogging, in a manufacturing process of silver halide photographic light-sensitive material, or during storage or processing of the material. As the compounds to be added, for example, 4-hydroxy-6-methyl-1,3,3a,7-tetrazaindene, 3-methyl-benzothiazole, 1-phenyl-5-mercaptotetrazol, and further, very many compounds such as well-known heterocyclic compounds, mercury-containing compounds, mercapto compounds, and metallic salts are known.

The silver halide emulsion can be chemically sensitized by an ordinary method. Examples of a chemical sensitizer include gold compounds such as chloroaurate and gold trichloride; salts of precious metal such as platinum, palladium, iridium, rhodium and ruthenium; sulfur compounds which react with silver salt to form silver sulfide; stannous salts, amines and other reducing substances.

The silver halide emulsion can be, if necessary, subjected to spectral sensitization or supersensitization by using cyanine dyes such as cyanine, merocyanine or carbocyanine, singly or in a combination of two or more, or by using any one or more of the cyanine dyes in combination with styryl dye(s).

In the non-light-sensitive photographic constitutional layer, stilbene, triazine, oxazole, coumarin-based compounds or the like may be contained as a whitening agent. Further, benzotriazole, thiazolidine, cinnamic acid ester-based compounds or the like may be contained as an ultraviolet absorbing agent, and various well-known photographic filter dyes may be contained as a light absorbing agent.

If necessary, the silver halide emulsion layer can contain, as a lubricating agent or adhesion inhibitor, for example, fatty acid amide or ester, and polyester thereof which are described in U.S. Pat. No. 2,732,305, U.S. Pat. No. 4,042,399, U.S. Pat. No. 3,121,060, and British Patent No. 1,466,304; water-insoluble substances described in British Patent No. 1,320,564, British Patent No. 1,320,565, and U.S. Pat. No. 3,121,060; and surface active materials described in U.S. Pat. No. 3,617,286. The protective layer may contain, as a matting agent, inorganic compounds such as silica, barium strontium sulfate, organic polymers such as polymethylmethacrylate and polystyrene, or the like, having an appropriate grain size.

Further, the silver halide emulsion layer can also contain, for example, hydrophilic polymer described in U.S. Pat. No. 2,725,297, U.S. Pat. No. 2,972,535, U.S. Pat. No. 2,972,536, U.S. Pat. No. 2,972,537, U.S. Pat. No. 2,972,538, U.S. Pat. No. 3,033,679, U.S. Pat. No. 3,072,484, U.S. Pat. No. 3,262,807, U.S. Pat. No. 3,525,621, U.S. Pat. No. 3,615,531, U.S. Pat. No. 3,630,743, U.S. Pat. No. 3,653,906, U.S. Pat. No. 3,655,384, U.S. Pat. No. 3,655,386, British Patent No. 1,222,154 and British Patent No. 1,235,075; hydrophobic polymer described in U.S. Pat. No. 2,973,263 and U.S. Pat. No. 2,976,148; biguanide compound described in U.S. Pat. No. 2,584,362 and U.S. Pat. No. 2,591,590; sulfonic acid type anion compound described in U.S. Pat. No. 2,639,234, U.S. Pat. No. 2,649,372, U.S. Pat. No. 3,201,251 and U.S. Pat. No. 3,457,076; phosphoric ester and quaternary ammonium salts described in U.S. Pat. No. 3,317,344 and U.S. Pat. No. 3,514,291; cationic compound described in U.S. Pat. No. 2,882,157, U.S. Pat. No. 2,982,651, U.S. Pat. No. 3,399,995, U.S. Pat. No. 3,549,369 and U.S. Pat. No. 3,564,043; nonionic compound described in U.S. Pat. No. 3,625,695; amphoteric compound described in U.S. Pat. No. 3,736,268; complex compound described in U.S. Pat. No. 2,647,836; and organic salts described in U.S. Pat. No. 2,717,834 and U.S. Pat. No. 3,655,387.

The silver halide photographic light-sensitive material for movie according to the present invention may be for black/white photography or color photography. A silver halide color photographic light-sensitive material for movie, in which a dye-forming coupler(s) is used, is preferred. The silver halide photographic light-sensitive material for movie mentioned herein means general motion picture films such as color negative films for movie, positive films for movie and the like. In the present invention, positive films for movie are especially preferred.

A typical example of the silver halide color photographic light-sensitive material for movie is a silver halide photographic light-sensitive material in which light-sensitive layers comprised of a plurality of silver halide photographic light-sensitive layers having substantially different color sensitivities are formed. The above-described light-sensitive layers are formed in such a manner that unit photosensitive layers each having a color sensitivity for one of light of blue, green and red are provided in a layered form.

In the silver halide emulsion which constitutes the silver halide emulsion layer of the silver halide color photographic light-sensitive material for movie shooting, as silver halide, silver iodobromide, silver iodochloride and silver iodochlorobromide, each having a silver iodide content of about 0.5 to 30 mol %, are suitably used. Among them, silver iodobromide or silver iodochlorobromide, each having a silver iodide content of about 2 to 10 mol %, is particularly preferable. Suitable silver halide for the silver halide emulsion which constitutes a silver halide photographic light-sensitive layer of a color positive film for movie, is silver chlorobromide or silver chloride. Among them, a silver halide emulsion having a silver chloride content of 95 mol % or more, preferably 98 mol % or more, and also containing silver bromide and/or silver iodide for the rest, is preferable.

The shape of the silver halide emulsion grains is not particularly limited; preferably the shape is cubic or tetradecahedron, and more preferably cubic.

The size of silver halide grains in the silver halide emulsion is preferably from 0.1 μm to 0.7 μm in terms of side length. In the yellow-developable light-sensitive silver halide emulsion layer, the size of silver halide grains is preferably from 0.3 μm to 0.7 μm, and in the cyan-developable light-sensitive silver halide emulsion layer, the size of silver halide grains is preferably from 0.1 μm to 0.3 μm, and in the magenta-developable light-sensitive silver halide emulsion layer, the size of silver halide grains is preferably from 0.1 μm to 0.2 μm, in terms of side length.

It is preferred that each of the yellow-developable light-sensitive silver halide emulsion layer, the cyan-developable light-sensitive silver halide emulsion layer, and the magenta-developable light-sensitive silver halide emulsion layer uses at least two, preferably three or more kinds of silver halide emulsions having different sensitivities from each other in combination. Here, the following case is preferred: at least two kinds, preferably at least three kinds of silver halide emulsions different in the size of silver halide grains from each other are used in combination.

The silver halide emulsion for use in the present invention may contain various kinds of metal complexes. Especially, it is preferred to contain a 6-coordinate complex in which Iridium is incorporated as a central metal. As for the metal complex, those described in, for example, paragraphs [0041] to [0055] of JP-A 2005-215533 are preferred. In addition, it is preferred that all of the six ligands are halogen ions (preferably chlorine ion), or alternatively at least one ligand is a 5-membered heterocycle containing sulfur atom(s) and nitrogen atom(s) as ring-constituting atoms (for example, thiazole ring which may have a substituent group). Further, it is also preferred to contain other metal complexes excepting the Iridium complex. Examples of the other metal complexes include those described in paragraphs [0059] to [0061] of JP-A 2005-215533. Especially, it is also preferred to contain an iron complex, and more preferably an iron complex in which all of six ligands are cyano ions ($CN^-$). It is also preferred to use the above-described 6-coordinate complex in which Iridium is incorporated as a central metal, in combination with the above-described other metal complex excepting the Iridium complex. The amount of the 6-coordinate complex in which Iridium is incorporated as a central metal is preferably from $1\times10^{-10}$ mole to $1\times10^{-3}$ mole, and more preferably from $1\times10^{-8}$ mole to $1\times10^{-5}$ mole, per mole of silver. The amount of the other metal complex excepting the Iridium complex is preferably from $1\times10^{-10}$ mole to $1\times10^{-2}$ mole per mole of silver, and especially in the case of hexacyano iron complex, the amount thereof is more preferably from $1\times10^{-6}$ mole to $5\times10^{-4}$ mole per mole of silver.

The silver halide emulsion can be prepared by the methods described in, for example, Research Disclosure (hereinafter abbreviated as RD) No. 17643 (December 1978), pages 22 to 23, "I. Emulsion preparation and types", No. 18716 (November 1979), page 648, and No. 307105 (November 1989), pages 863 to 865; "Chimie et Physique Photographique" by P. Glafkides, Paul Montel, 1967; "Photographic Emulsion Chemistry" by G. F. Duffin, Focal Press, 1966; and "Making and Coating Photographic Emulsion" by V. L. Zelikman et al., Focal Press, 1964.

Normally, the silver halide emulsion is used after being subjected to physical ripening, chemical ripening, and spectral sensitization. The photographic additives that can be used in these steps are described in the following Research Disclosures (RD), whose particular parts are given below in the following table.

| | Kind of Additive | RD 17643 | RD 18716 | RD 307105 |
|---|---|---|---|---|
| 1 | Chemical sensitizers | p. 23 | p. 648 (right column) | p. 866 |
| 2 | Sensitivity-enhancing agents | | p. 648 (right column) | |
| 3 | Spectral sensitizers and Supersensitizers | pp. 23-24 | pp. 648 (right column)-649 (right column) | pp. 866-868 |
| 4 | Brightening agents | p. 24 | pp. 647 (right column) | p. 868 |
| 5 | Light absorbers, Filter dyes, and UV Absorbers | pp. 25-26 | pp. 649 (right column)-650 (left column) | p. 873 |
| 6 | Binders | p. 26 | p. 651 (left column) | pp. 873-874 |
| 7 | Plasticizers and Lubricants | p. 27 | p. 650 (right column) | p. 876 |
| 8 | Coating aids and Surfactants | pp. 26-27 | p. 650 (right column) | pp. 875-876 |
| 9 | Antistatic agents | p. 27 | p. 650 (right column) | pp. 876-877 |
| 10 | Matting agents | | | pp. 878-879 |

In the silver halide photographic light-sensitive material of the present invention, the following dye-forming couplers are particularly preferably used, though various dye-forming couplers can be used:

Yellow couplers: couplers represented by the formula (I) or (II) in EP 502,424 A; couplers represented by the formula (1) or (2) in EP 513,496 A (particularly, Y-28 on page 18); couplers represented by the formula (I) in Claim 1 in JP-A-5-307248; couplers represented by the formula (I) in U.S. Pat. No. 5,066,576, column 1, line 45 to line 55; couplers represented by the formula (I) in JP-A-4-274425, Paragraph 0008; couplers described in Claim 1 in EP 498,381 A1, page 40 (particularly, D-35 on page 18); couplers represented by the formula (Y) in EP 447,969 A1, page 4 (particularly Y-1 (page 17) and Y-54 (page 41)); and couplers represented by one of the formulae (II) to (IV) in U.S. Pat. No. 4,476,219, column 7, line 36 to line 58 (particularly, II-17 and -19 (column 17) and II-24 (column 19)).

Magenta couplers: JP-A-3-39737 (L-57 (page 11, lower right), L-68 (page 12, lower right), L-77 (page 13, lower right)); A-4-63 (page 134), A-4-73 and -75 (page 139) in EP 456,257; M-4, -6 (page 26) and M-7 (page 27) in EP 486,965; M-45 in JP-A-6-43611, Paragraph 0024; M-1 in JP-A-5-204106, Paragraph 0036; and M-22 in JP-A-4-362631, Paragraph 0237.

Cyan couplers: CX-1, 3, 4, 5, 11, 12, 14 and 15 (page 14 to page 16) in JP-A-4-204843; C-7, 10 (page 35), 34, 35 (page 37), (1-1), (1-17) (page 42 to page 43) in JP-A-4-43345; and couplers represented by the formula (Ia) or (Ib) in Claim 1 in JP-A-6-67385.

Polymer couplers: P-1 and P-5 (page 11) in JP-A-2-44345.

As couplers that form a color dye having suitable diffusion characteristics, those described in U.S. Pat. No. 4,366,237, GB 2,125,570, EP 96,873B, and DE 3,234,533 are preferable.

As couplers for compensating unnecessary absorption of color dye, yellow-colored cyan couplers represented by the formula (CI), (CII), (CIII) or (CIV) described on page 5 in EP 456,257 A1 (particularly YC-86, on page 84), yellow-colored magenta couplers ExM-7 (page 202), EX-1 (page 249) and Ex-7 (page 251) described in the same EP publication, magenta-colored cyan couplers CC-9 (column 8) and CC-13 (column 10) described in U.S. Pat. No. 4,833,069, (2) (on column 8) of U.S. Pat. No. 4,837,136, and colorless masking couplers represented by the formula (A) described in Claim 1 in WO92/11575 (particularly, the exemplified compounds on page 36 to page 45) are preferable.

(Non-Light-Sensitive Photographic Constitutional Layer)

In the silver halide photographic light-sensitive material for movie according to the present invention, light-insensitive photographic constitutional layers other than the above-described undercoating layer may be provided at the silver halide emulsion layer side.

The above-described silver halide emulsion layer can be formed by applying, on a support or on an undercoating layer provided on the support, the coating liquid for a silver halide light-sensitive layer, which is prepared as a silver halide emulsion as described above, using a well-known coating method. In this case, formation of layers on the support is generally carried out in such a manner that an undercoating layer is formed on one side of the substrate, and thereafter, another undercoating layer (an undercoating layer which also functions as an antistatic layer) and a protective layer are formed on another side thereof sequentially in this order, and an antihalation layer, and a silver halide emulsion layer(s) are formed on the first undercoating layer.

(Outermost Layer)

The silver halide photographic light-sensitive material for movie according to the present invention may have a structure in which an outermost layer (protective layer) is provided on the outermost of the side having the above-described silver halide emulsion layer, primarily in order to improve both sliding property and scratch resistance.

The outermost layer may be provided directly or via another layer on the above-described silver halide emulsion layer.

The outermost layer may contain silicone oil, and if needed, may contain other components such as gelatin, a matting agent, a surfactant, a sliding agent or the like.

(Silicone Oil)

The silicone oil is not particularly limited. Examples of the silicone oil include silicone oil modified with an organic group such as a structure in which a side chain of a siloxane structure is modified with an organic group; a structure in which both terminals of the siloxane structure are modified with an organic group; or a structure in which one terminal of the siloxane structure is modified with an organic group.

Examples of modification with the organic group include amino modification, polyether modification, epoxy modification, carboxyl modification, carbinol modification, alkyl modification, aralkyl modification, phenol modification, and fluorine modification.

Among the above silicone oils, dimethylsiloxane in which the side chain of a siloxane structure is substituted with methyl groups is preferable from the view points of a sliding property and a coating property.

Specifically, the silicone oil is also available as commercial products, for example, KF96-10CS (trade name, manufactured by Shin-Etsu Chemical Co., Ltd.).

(Other Components)

The above-described outermost layer may contain a hydrophilic colloid as a binder, in order to improve film strength, and to prevent or suppress white powder contamination and deterioration of a developing solution, and liability for maintenance of an automatic processor.

Examples of the hydrophilic binder include the same compounds as those usable in the silver halide emulsion layer (for example, gelatin).

A surfactant may be used in order to increase a sliding property of the surface of the outermost layer. Examples of the surfactant include known surfactants that are described as other components for the above-described undercoating layer. Especially, a fluorine-based surfactant may be favorably used. Known fluorine-based surfactants may be used as the fluorine-based surfactant.

As for the above-described matting agent, various kinds of matting agents may be used as long as they do not have harmful effects on photographic properties in particular. It is possible to use the same matting agents as those usable in the above-described undercoating layer.

Further, each of the surfactant and the matting agent may be used singly or in combination of two or more kinds thereof.

The present invention should not be limited to these matters.

(Antihalation Layer)

In the present invention, it is preferred to have an antihalation layer on or above the above-described undercoating layer provided on the support. The antihalation layer preferably contains a solid fine particle dispersion of dye. The antihalation layer described in JP-A 2007-264031 is preferably applied as the above antihalation layer.

The present invention attains to provide a silver halide photographic light-sensitive material for movie, the silver halide photographic light-sensitive material capable of suppressing generation of a static fogging mark that is caused by accumulation of a charge before processing, and capable of exhibiting excellent transport property without promoting adsorption of dust and dirt at the user use after processing. That is to say, the present invention contributes to provide a silver halide photographic light-sensitive material for movie, the silver halide photographic light-sensitive material capable of achieving a good balance between suppression of generation of electrostatic fogging mark and reduction of electrostatic adhesion or attachment of dust at the time when the photographic light-sensitive material is used with a cinema projector. According to previous photographic light-sensitive materials, it was difficult to address these problems at the same time.

The present invention makes it possible to provide a silver halide photographic light-sensitive material for movie, the silver halide photographic light-sensitive material exhibiting favorable effects on the following points:

No accumulation of charge even though high-speed printing (ordinary transport velocity: 600 m/min or more, preferably high-speed exposure of 762 m/min or more) is performed at the time of using the silver halide photographic light-sensitive material in a processing laboratory;

No generation of electrostatic fogging pattern caused by discharge; and

Stably hard to promote adsorption of dust and dirty even though a color developing time is substantially changed, and resultantly hard to cause a failure of transport due to an electrically-charged charge.

The present invention will be described in more detail based on examples given below, but the invention is not meant to be limited by these examples.

EXAMPLES

Example 1

<Preparation of Sample 101>

[Preparation of Support]

A film was biaxially drawn 3.3 times in each of the length and width directions, and then the resultant was thermally fixed at 240° C. for 10 minutes. Thereafter, both surfaces of the resultant film were subjected to corona discharge treatment, to give a polyethylene terephthalate film (PET film) having 120 μm in thickness.

[Formation of First Undercoating Layer and Second Undercoating Layer at the Side of Silver Halide Emulsion Layer]

Prepared were a coating solution for forming a first undercoating layer and a coating solution for forming a second undercoating layer (hereinafter, also referred to as a "coating solution for a first undercoating layer" and a "coating solution for a second undercoating layer") having the compositions described below, respectively.

Subsequently, the coating solution for the first undercoating layer was first applied onto one of the surfaces of the PET film by a bar coater, and the resultant was dried at 180° C. for 30 seconds, to form a first undercoating layer having 0.3 μm in thickness.

Furthermore, the coating solution for the second undercoating layer was applied onto the first undercoating layer by the bar coater, and the resultant was dried at 170° C. for 30 seconds, to form a second undercoating layer having 0.15 μm in thickness.

The resultant was in a state that the first and second undercoating layers were laminated in this order on the support.

An amount by mass of each of dispersion liquids was expressed as "part", providing that the amount by mass of a coating liquid is 100.

| <<Coating solution for first undercoating layer at the side of silver halide emulsion layer, i.e. at the side in which silver halide emulsion layer is provided>> | |
|---|---|
| Styrene/butadiene copolymer latex (trade name: LX-407C5, manufactured by Nippon Zeon Co., Ltd.; styrene/butadiene = 67/30, and solid content: 40 mass %) | 14.1 parts |
| 2,4-Dichloro-6-hydroxy-s-triazine (solid content: 8 mass %) | 2.5 parts |
| Polystyrene particles (trade name: UFN 1008, manufactured by Nippon Zeon Co., Ltd.; average particle diameter: 2 μm, and solid content: 20 mass %) | 0.04 parts |
| Distilled water | 83.4 parts |

| <<Coating solution for second undercoating layer at the side of silver halide emulsion layer>> (total amount: 99.9 mass parts) | |
|---|---|
| Gelatin (trade name: PHOTOGRAPHIC GELATIN 681 TYPE, manufactured by Nitta Gelatin Inc.; solid content: 10 mass %) | 14.8 parts |
| Acetic acid (solid content: 20%) | 1.0 part |
| The following compound (1) (solid content: 1.5 mass %) | 2.2 parts |
| The following compound (2) (solid content: 3.5 mass %): | 0.1 part |
| Cellulose (trade name: Hypromellose TC-5, manufactured by Shin-Etsu Chemical Co., Ltd.; solid content: 2 mass %) | 2.3 parts |
| Distilled water | 79.5 parts |

Compound (1)

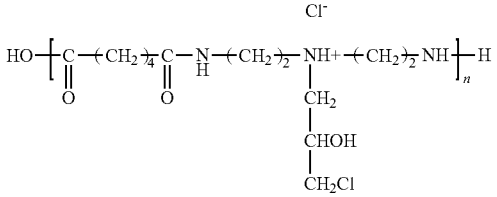

Number average molecular weight: 10000

Compound (2)

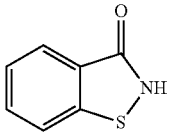

[Formation of Back-Side First Undercoating Layer]

Subsequently, a coating solution for a back-side first undercoating layer (a first undercoating layer provided at the back side) having the following composition was applied onto the support surface, on which the undercoating layers were not provided, by the bar coater, and the resultant was dried at 180° C. for 30 seconds, to give an antistatic layer (a back-side first undercoating layer) having 0.1 μm in thickness.

| <<Coating solution for back-side first undercoating layer>> | |
|---|---|
| Polyacrylic resin water dispersion liquid (trade name: JURYMER ET410, manufactured by Nihon Junyaku Co., Ltd.; solid content: 27 mass %) | 2.1 parts |
| Tin oxide-antimony oxide dispersion (trade name: TDL-1, manufactured by Mitsubishi Materials Corp.; average particle diameter: 0.1 μm, and solid content: 17 mass %) | 9.1 parts |
| Carbodiimide compound (trade name: CARBODILITE V02-L2, manufactured by Nisshinbo Industries Inc.; solid content: 10 mass %) | 1.8 parts |
| Surfactant (The following compound (3)) (sulfomethyl succinate; solid content: 0.1 mass %) | 8.7 parts |
| Sodium alkylsulfonate (trade name: SANDET BL, manufactured by Sanyo Chemicals Co., Ltd.; solid content: 10 mass %) | 0.6 part |
| Polyoxyalkylene alkylether (trade name: NAROACTY CL-95, manufactured by Sanyo Chemical Industries, Ltd.; solid content: 1 mass %) | 6.2 parts |

-continued

| <<Coating solution for back-side first undercoating layer>> | |
|---|---|
| Mat agent (trade name: MP-1000, manufactured by Soken Chemical & Engineering Co., Ltd.; average particle diameter: 0.4 μm, and solid content: 5 mass %) | 1.0 part |
| Distilled water | 76.7 parts |

Compound (3)

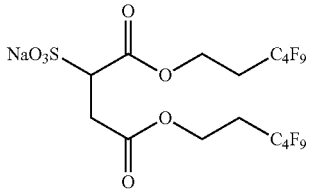

[Formation of Back-Side Protective Layer]

Subsequently, a coating solution for a back-side protective layer (a protective layer provided at the back side) having the following composition was applied onto the antistatic layer by the bar coater, and the resultant was dried at 170° C. for 30 seconds, to form a protective layer having 0.03 μm in thickness.

| <<Coating solution for back-side protective layer>> | |
|---|---|
| Polyolefin ionomer (trade name: CHEMIPEARL S-75N, manufactured by Mitsui Chemicals, Inc.; solid content: 24 mass %) | 2.6 parts |
| Colloidal silica (trade name: SNOWTEX C, manufactured by Nissan Chemical Industries, Ltd.; solid content: 20 mass %) | 1.1 parts |
| Epoxy compound (trade name: DENACOL EX-614B, manufactured by Nagase Chemicals, Ltd.; solid content: 1 mass %) | 22.2 parts |
| Polyoxyalkylene alkylether (trade name: NAROACTY CL-95, manufactured by Sanyo Chemical Industries, Ltd.; solid content: 1 mass %) | 6.8 parts |
| Polyethylenedioxythiophene/polystyrene sulfonic acid (trade name: Orgacon HBS, manufactured by Agfa; solid content: 1.2 mass %) | 3.6 parts |
| Ethylene glycol (manufactured by Wako Pure Chemical Industries, solid content: 10 mass %) | 5.2 parts |
| Carnauba wax (trade name: SELOSOL 524, manufactured by Chukyou Yushi Co., Ltd., solid content: 3 mass %) | 0.4 part |
| Distilled water | 58.8 parts |

Compound (4)

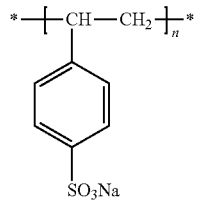

Number average molecular weight : 660000

<Preparation of Silver Halide Emulsion>

(Preparation of Silver Halide Emulsion)

(Preparation of Blue-Sensitive Layer Emulsion BH-1)

High silver chloride cubic grains were prepared by a method in which sulfuric acid was added to deionized water containing a deionized gelatin while stirring to adjust pH to 2.0, and then a 1% aqueous solution of Pluronic (registered trademark) 31R1 manufactured by BASF (3.0 mL per mol of finished silver halide) was added, and then silver nitrate and sodium chloride were simultaneously added and mixed to form a silver halide. In the course of this preparation, over the step from 80% to 90% addition of the entire silver nitrate amount, $K_4[Fe(CN)_6]$ ($9.2\times10^{-5}$ mol per mol of the finished silver halide) and $K_2[IrCl_5(5\text{-methylthiazole})]$ ($2.8\times10^{-8}$ mol per mol of the finished silver halide) were added. Over the step from 90% to 100% addition of the entire silver nitrate amount, potassium bromide (0.5 mol % to the total amount of the finished silver halide) and $K_2[IrCl_5(H_2O)]$ ($6.1\times10^{-5}$ mol per mol of the finished silver halide) were added. Over the step from 92% to 94% addition of the entire silver nitrate amount, potassium iodide (0.20 mol % to the total amount of the finished silver halide) was added under vigorous stirring. The thus-obtained emulsion grains were monodisperse cubic silver iodobromochloride grains having a side length of 0.65 and a variation coefficient of 7.4%. The thus-obtained emulsion was subjected to a precipitation-desalting treatment by adding thereto an aqueous solution of a maleic acid/isobutene copolymer and adequately adjusting pH of the emulsion. Thereafter, to the emulsion, a deionized gelatin and the following additives were added and re-dispersed. Namely, the additives herein added were a 1% aqueous solution of Pluronic (registered trademark) 31R1 manufactured by BASF (3.9 mL per mol of the finished silver halide), the following compound Ab-1 (0.05 g per kg of the chemically sensitized finished emulsion), the following compound Ab-2 (0.05 g per kg of the chemically sensitized finished emulsion), the following compound Ab-3 (5.5 g per kg of the chemically sensitized finished emulsion), and calcium nitrate (1.8 g per kg of the chemically sensitized finished emulsion). The halogen composition (%) of the emulsion grains was Cl/Br/I=99.3/0.5/0.2.

(Ab-1)

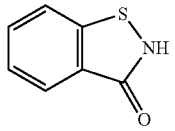

Antiseptic (Ab-2)

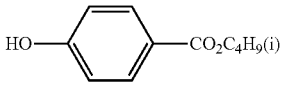

Antiseptic (Ab-3)

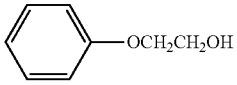

Antiseptic

To the emulsion thus re-dispersed, a sodium hydroxide aqueous solution was added and the pH value of the emulsion was adjusted to 5.70 at 40° C. A sodium chloride aqueous solution was added to the emulsion, thereby adjusting pAg to 7.65 at 40° C. The emulsion was spectrally sensitized by adding thereto the following sensitizing dye S-1 ($3.6\times10^{-4}$ mol per mol of silver halide) and the following sensitizing dye S-2 ($7.9\times10^{-5}$ mol per mol of silver halide). Then, the emulsion was chemically sensitized by adding thereto sodium benzenethiosulfonate ($6.2\times10^{-6}$ mol per mol of silver halide), sodium thiosulfate pentahydrate ($1.3\times10^{-5}$ mol per mol of silver halide) as a sulfur sensitizer and chloroauric acid tetrahydrate ($4.5\times10^{-6}$ mol per mol of silver halide) as a gold sensitizer, and further by ripening the emulsion so that chemical sensitization was optimized. Then, 1-(5-methylureidophenyl)-5-mercaptotetrazole ($3.2\times10^{-4}$ mol per mol of silver halide), the following Compound-1 ($1.0\times10^{-5}$ mol per mol of silver halide), a compound including two or three of recurring unit represented by the following Compound-2 (the terminal X1 and X2 each represent a hydroxyl group) ($1.2\times10^{-1}$ g per mol of silver halide) as a main component, the following Compound-3 ($7.8\times10^{-5}$ mol per mol of silver halide), and potassium bromide ($6.9\times10^{-3}$ mol per mol of silver halide) were added to complete chemical sensitization. The thus-obtained emulsion was designated as Emulsion BH-1. The finished emulsion contains 110 g of silver halide in equivalent to metal silver, and 77 g of gelatin per 1 kg of the finished emulsion.

Sensitizing dye S-1

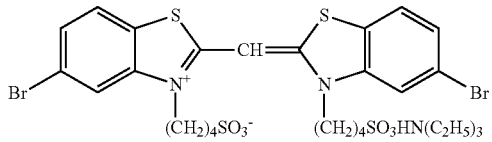

Sensitizing dye S-2

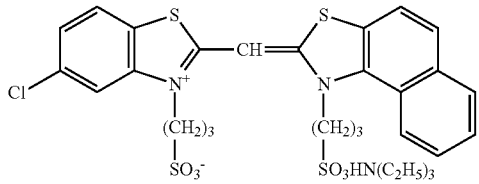

Compound-1

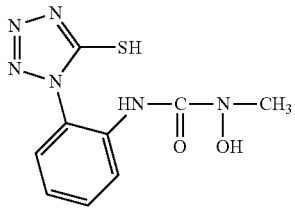

Compound-2

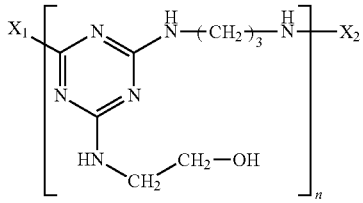

Compound-3

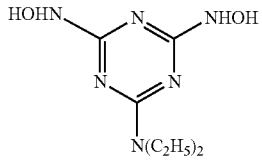

(Preparation of Blue-Sensitive Layer Emulsion BM-1)

High silver chloride cubic grains were prepared in the same as the preparation of the Emulsion BH-1, except for changing a temperature and the addition rate in the step of simultaneously adding silver nitrate and sodium chloride and mixing them. The thus-obtained emulsion grains were mono-dispersed cubic silver iodobromochloride grains having a side length of 0.43 μm and a variation coefficient of 6.5%. This emulsion was re-dispersed by subjecting the emulsion to a deposition desalting treatment in the same manner as in the Emulsion BH-1. Then, Emulsion BM-1 was prepared in the same as in the Emulsion BH-1, except that addition amounts of various compounds were each changed so that the amount of each compound per unit surface area of silver halide grain was the same as that of the Emulsion BH-1. The finished emulsion contains 95 g of silver halide in equivalent to metal silver, and 66 g of gelatin per 1 kg of the finished emulsion.

(Preparation of Blue-Sensitive Layer Emulsion BL-1)

High silver chloride cubic grains were prepared by a method in which sulfuric acid was added to deionized water containing an alkali-treated deionized gelatin while stirring to adjust pH to 2.0, and then a 1% aqueous solution of Pluronic (registered trademark) 31R1 manufactured by BASF (3.0 mL per mol of the finished silver halide) was added, and then silver nitrate and sodium chloride were simultaneously added and mixed to form a silver halide. In the course of this preparation, over the step from 70% to 85% addition of the entire silver nitrate amount, $K_4[Fe(CN)_6]$ ($6.2\times10^{-5}$ mol per mol of the finished silver halide), $K_2[IrCl_5(5\text{-methylthiazole})]$ ($1.9\times10^{-8}$ mol % per mol of the finished silver halide) and $K_3[RhBr_5(H_2O)]$ ($2.2\times10^{-8}$ mol per mol of the finished silver halide) were added. Over the step from 85% to 100% addition of the entire silver nitrate amount, potassium bromide (0.5 mol % to the total amount of the finished silver halide) and $K_2[IrCl_5(H_2O)]$ ($3.6\times10^{-5}$ mol per mol of the finished silver halide) were added. Over the step from 92% to 94% addition of the entire silver nitrate amount, potassium iodide (0.33 mol % to the total amount of the finished silver halide) was added under vigorous stirring. The thus-obtained emulsion grains were monodisperse cubic silver iodobromochloride grains having a side length of 0.33 μm and a variation coefficient of 9.1%. The thus-obtained emulsion was subjected to a precipitation-desalting treatment by adding an aqueous solution of a maleic acid/isobutene copolymer to the emulsion and adequately adjusting pH of the emulsion. Thereafter, to the emulsion, an alkali-treated deionized gelatin and the following additives were added and re-dispersed. Namely, the additives herein added were a 1% aqueous solution of Pluronic (registered trademark) 31R1 manufactured by BASF (3.5 mL per mol of the finished silver halide), the compound Ab-1 (0.05 g per kg of the chemically sensitized finished emulsion), the compound Ab-2 (0.05 g per kg of the chemically sensitized finished emulsion), the compound Ab-3 (5.0 g per kg of the chemically sensitized finished emulsion), and calcium nitrate (2.8 g per kg of the chemically sensitized finished emulsion). The halogen composition (%) of the emulsion grains was Cl/Br/I=99.17/0.5/0.33.

To the emulsion thus re-dispersed, a sodium hydroxide aqueous solution was added and the pH value of the emulsion was adjusted to 5.70 at 40° C. To the emulsion thus re-dispersed, a sodium hydroxide aqueous solution was added and the pAg value of the emulsion was adjusted to 7.65 at 40° C. The emulsion was spectrally sensitized by adding thereto the sensitizing dye S-1 ($5.4\times10^{-4}$ mol per mol of silver halide) and the sensitizing dye S-2 ($1.4\times10^{-4}$ mol per mol of silver halide). Then, the emulsion was chemically sensitized by adding thereto sodium benzenethiosulfonate ($1.0\times10^{-5}$ mol per mol of silver halide), sodium thiosulfate pentahydrate ($2.1\times10^{-5}$ mol per mol of silver halide) as a sulfur sensitizer, and chloroauric acid tetrahydrate ($1.4\times10^{-5}$ mol per mol of silver halide) as a gold sensitizer, and further by ripening the emulsion so that chemical sensitization was optimized. Then, 1-(5-methylureidophenyl)-5-mercaptotetrazole ($5.4\times10^{-4}$ mol per mol of silver halide), the Compound-1 ($1.0\times10^{-5}$ mol per mol of silver halide), the compound including two or three of recurring unit represented by the Compound-2 (the terminal X1 and X2 each represent a hydroxyl group) ($2.0\times10^{-1}$ g per mol of silver halide) as a main component, the Compound-3 ($1.3\times10^{-4}$ mol per mol of silver halide), and potassium bromide ($8.9\times10^{-3}$ mol per mol of silver halide) were added to complete chemical sensitization. The thus-obtained emulsion was designated as Emulsion BL-1. The finished emulsion contains 100 g of silver halide in equivalent to metal silver, and 63 g of gelatin per kg of the finished emulsion.

(Preparation of Red-Sensitive Layer Emulsion RH-1)

High silver chloride cubic grains were prepared by a method in which sulfuric acid was added to deionized water containing an alkali-treated gelatin while stirring to adjust pH to 2.5, and then silver nitrate and sodium chloride were simultaneously added and mixed to form a silver halide. In the course of this preparation, over the step from 0% to 50% addition of the entire silver nitrate amount, potassium bromide (32.5 mol % to the total amount of the finished silver halide) was added. Over the step from 50% to 100% addition of the entire silver nitrate amount, $K_4[Fe(CN)_6]$ ($5.5\times10^{-5}$ mol per mol of the finished silver halide), $K_2[IrCl_5(5\text{-methylthiazole})]$ ($3.4\times10^{-7}$ mol per mol of the finished silver halide), and potassium bromide (17.5 mol % to the total amount of the finished silver halide) were added. After the addition of silver nitrate was completed, a 1% aqueous solution of Pluronic (registered trademark) 31R1 manufactured by BASF (10.6 mL per mol of the finished silver halide) and 2% aqueous solution of RNA-F3 manufactured by NIPPON PAPER Chemicals CO., LTD. (20.6 mL per mol of the finished silver halide) were added. The thus-obtained emulsion grains were monodisperse cubic silver chlorobromide grains having a side length of 0.23 μm and a variation coefficient of 11.0%. The thus-obtained emulsion was subjected to a precipitation-desalting treatment by adding thereto an aqueous solution of a maleic acid/isobutene copolymer and adequately adjusting pH of the emulsion. Thereafter, to the emulsion, an alkali-treated gelatin was added and the emulsion was re-dispersed. The halogen composition (%) of the emulsion grains was Cl/Br/I=75/25/0.

To the emulsion thus re-dispersed, a sodium hydroxide aqueous solution was added and the pH value of the emulsion was adjusted to 6.15 at 40° C. Then, the emulsion was chemically sensitized by adding thereto sodium benzenethiosulfonate ($7.1\times10^{-5}$ mol per mol of silver halide), triethylthiourea ($1.1\times10^{-5}$ mol per mol of silver halide) as a sulfur sensitizer, and chloroauric acid tetrahydrate ($7.2\times10^{-6}$ mol per mol of silver halide) as a gold sensitizer, and further by ripening the emulsion so that chemical sensitization was optimized. Then, 1-(5-methylureidophenyl)-5-mercaptotetrazole ($1.5\times10^{-3}$ mol per mol of silver halide), the following Compound-4 ($9.5\times10^{-4}$ mol per mol of silver halide) were added to complete chemical sensitization. Subsequently, the emulsion was spectrally sensitized by adding thereto the following sensitizing dye S-3 ($5.7\times10^{-5}$ mol per mol of silver halide) and the following Compound-5 ($7.8\times10^{-4}$ mol per mol of silver halide). Finally, the Compound Ab-1 (0.05 g per kg of the chemically sensitized finished emulsion) and the Compound Ab-3 (1.0 g per kg of the chemically sensitized finished emulsion) were added. The thus-obtained emulsion was designated as Emulsion RH-1. The finished emulsion contains 85 g of silver halide in equivalent to metal silver, and 71 g of gelatin per kg of the finished emulsion.

Compound-4

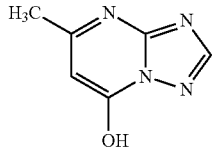

Sensitizing dye S-3

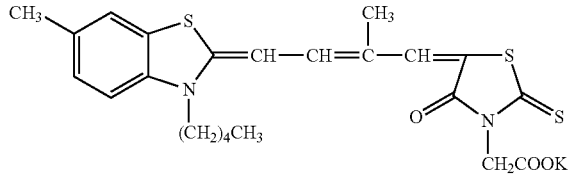

Compound-5

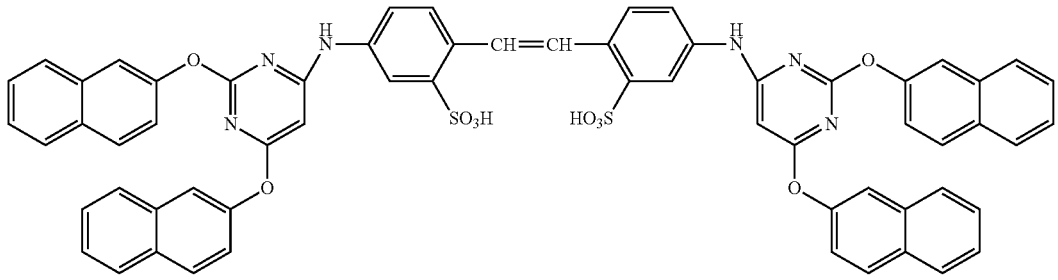

(Preparation of Red-Sensitive Layer Emulsion RM-1)

High silver chloride cubic grains were prepared in the same manner as in the preparation of the Emulsion RH-1, except that a temperature and the addition rate were changed in the step of simultaneously adding silver nitrate and sodium chloride and mixing them, and $K_2[IrCl_6]$ ($2.3\times10^{-7}$ mol per mol of the finished silver halide) was newly and continuously added over the step from 0% to 50% addition of the entire silver nitrate amount. Further, the amount of 2% aqueous solution of RNA-F3 manufactured by NIPPON PAPER Chemicals CO. LTD. that was added after the completion of addition of silver nitrate was change to 27.6 mL per mol of the finished silver halide. The thus-obtained emulsion grains were mono-dispersed cubic silver chlorobromide grains having a side length of 0.14 μm and a variation coefficient of 12.5%. This emulsion was re-dispersed by subjecting the emulsion to the deposition desalting processing in the same manner as in the Emulsion RH-1. The halogen composition (%) of the emulsion grains was Cl/Br/I=75/25/0.

To the emulsion thus re-dispersed, a sodium hydroxide aqueous solution was added and the pH value of the emulsion was adjusted to 6.15 at 40° C. Then, the emulsion was chemically sensitized by adding thereto sodium benzenethiosulfonate ($6.2\times10^{-5}$ mol per mol of silver halide), triethylthiourea ($2.4\times10^{-5}$ mol per mol of silver halide) as a sulfur sensitizer, and chloroauric acid tetrahydrate ($1.3\times10^{-5}$ mol per mol of silver halide) as a gold sensitizer, and further by ripening the emulsion so that chemical sensitization was optimized. Then, 1-(5-methylureidophenyl)-5-mercaptotetrazole ($1.3\times10^{-3}$ mol per mol of silver halide), the Compound-4 ($1.7\times10^{-3}$ mol per mol of silver halide) were added to complete chemical sensitization. Subsequently, the emulsion was spectrally sensitized by adding thereto the above-described sensitizing dye S-3 ($8.1\times10^{-5}$ mol per mol of silver halide) and the above-described Compound-5 ($9.5\times10^{-4}$ mol per mol of silver halide). Finally, the above-described Ab-1 (0.05 g per kg of the chemically sensitized finished emulsion) and the above-described Ab-3 (1.0 g per kg of the chemically sensitized finished emulsion) were added. The thus-obtained emulsion was designated as Emulsion RM-1. The finished emulsion contains 87 g of silver halide in equivalent to metal silver, and 73 g of gelatin per kg of the finished emulsion.

(Preparation of Red-Sensitive Layer Emulsion RL-1)

High silver chloride cubic grains were prepared in the same manner as in the preparation of the Emulsion RM-1, except that the addition amount of $K_2[IrCl_6]$ continuously added over the step from 0% to 50% addition of the entire silver nitrate amount was changed to $2.9\times10^{-7}$ mol per mol of the finished silver halide. The thus-obtained emulsion grains were mono-dispersed cubic silver chlorobromide grains having a side length of 0.14 μm and a variation coefficient of 12.5%. This emulsion was re-dispersed by subjecting the emulsion to the deposition desalting treatment in the same manner as in the Emulsion RH-1. The halogen composition (%) of the emulsion grains was Cl/Br/I=75/25/0. Chemical sensitization and spectral sensitization were performed in the same manner as those of Emulsion RM-1, except that the addition amount of the compound-5 was changed to $7.6\times10^{-5}$ mole per mole of silver halide, and 20 minutes of the time period for the chemical sensitization was shortened. Finally, the above-described Ab-1 (0.05 g per kg of the chemically sensitized finished emulsion) and the above-described Ab-3 (1.0 g per kg of the chemically sensitized finished emulsion) were added. The thus-obtained emulsion was designated as Emulsion RL-1. The finished emulsion contains 87 g of silver halide in equivalent to metal silver, and 73 g of gelatin per kg of the finished emulsion.

(Preparation of Green-Sensitive Layer Emulsion GH-1)

High silver chloride cubic grains were prepared by a method in which sulfuric acid was added to deionized water containing an alkali-treated deionized gelatin while stirring to adjust pH to 3.0, and a 0.5% aqueous solution of N,N-dimethylimidazolidine-2-thione ($7.2\times10^{-5}$ mol per mol of the finished silver halide) was added, and a 1% aqueous solution of Pluronic (registered trademark) 31R1 manufactured by BASF (4.7 mL per mol of the finished silver halide) was added, and silver nitrate and sodium chloride were simultaneously added and mixed to form a silver halide. In the course of this preparation, over the step from 0% to 50% addition of the entire silver nitrate amount, $K_2[IrCl_5(5\text{-methylthiazole})]$ ($6.6\times10^{-8}$ mol per mol of the finished silver halide) was added. Over the step from 50% to 100% addition of the entire silver nitrate amount, $K_4[Fe(CN)_6]$ ($1.4\times10^{-4}$ mol per mol of the finished silver halide) was added. After addition of the silver nitrate was completed, a 2% aqueous solution of RNA-F3 manufactured by NIPPON PAPER Chemicals CO., LTD.

(23.0 mL per mol of the finished silver halide) was added. Thereafter, the emulsion was spectrally sensitized by adding thereto the following sensitizing dye S-4 ($3.6\times10^{-4}$ mol per mol of silver halide), the following sensitizing dye S-5 ($7.7\times10^{-5}$ mol per mol of silver halide) and the following sensitizing dye S-6 ($1.4\times10^{-5}$ mol per mol of silver halide). Finally, the above-described Compound-4 was added ($2.0\times10^{-4}$ mol per mol of silver halide). The thus-obtained emulsion grains were monodisperse cubic silver chloride grains having a side length of 0.18 μm and a variation coefficient of 10.2%. The thus-obtained emulsion was subjected to a precipitation-desalting treatment by adding thereto an aqueous solution of a maleic acid/isobutene copolymer and adequately adjusting a pH of the emulsion. Thereafter, to the emulsion, an alkali-treated deionized gelatin and calcium nitrate (0.84 g per kg of the chemically sensitized finished emulsion) were added and the emulsion was re-dispersed. The halogen composition (%) of the emulsion grains was Cl/Br/I=100/0/0.

Sensitizing dye S-4

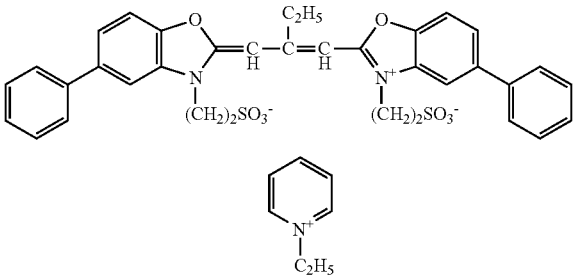

Sensitizing dye S-5

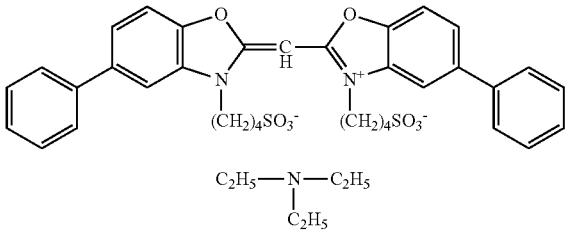

Sensitizing dye S-6

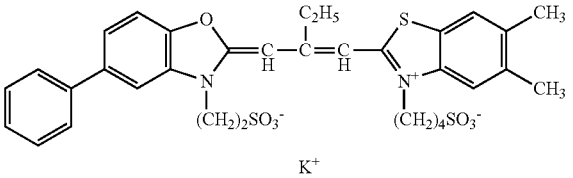

To the emulsion thus re-dispersed, a sodium hydroxide aqueous solution was added and the pH value of the emulsion was adjusted to 5.30 at 40° C. Then, the emulsion was chemically sensitized by adding thereto sodium benzenethiosulfonate ($2.7\times10^{-5}$ mol per mol of silver halide), triethylthiourea ($1.6\times10^{-5}$ mol per mol of silver halide) as a sulfur sensitizer and chloroauric acid tetrahydrate ($1.2\times10^{-5}$ mol per mol of silver halide) as a gold sensitizer, and further by ripening the emulsion so that chemical sensitization was optimized. Then, the following Compound-6 ($1.9\times10^{-3}$ mol per mol of silver halide), 1-(5-methylureidophenyl)-5-mercaptotetrazole ($7.5\times10^{-4}$ mol per mol of silver halide), potassium bromide ($1.7\times10^{-2}$ mol per mol of silver halide), and the following Compound-7 ($1.7\times10^{-4}$ mol per mol of silver halide) were added to complete chemical sensitization. Finally, the above-described compound Ab-1 (0.61 g per kg of the chemically sensitized finished emulsion) and the above-described compound Ab-3 (0.5 g per kg of the chemically sensitized finished emulsion) were added. The thus-obtained emulsion was designated as Emulsion GH-1. The finished emulsion contains 92 g of silver halide in equivalent to metal silver, and 65 g of gelatin per kg of the finished emulsion.

Compound-6

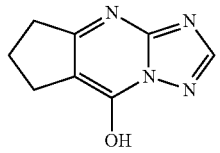

Compound-7

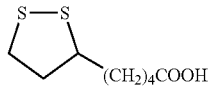

(Preparation of Green-Sensitive Layer Emulsion GM-1)

High silver chloride cubic grains were prepared in the same manner as in the preparation of the Emulsion GH-1, except that the addition rate was changed in the step of simultaneously adding silver nitrate and sodium chloride and mixing them, and the amount of $K_2[IrCl_5(5\text{-methylthiazole})]$ continuously added over the step from 0% to 50% addition of the entire silver nitrate amount was changed to $4.1\times10^{-7}$ mol per mol of the finished silver halide, and the amount of $K_4[Fe(CN)_6]$ continuously added over the step from 50% to 100% addition of the entire silver nitrate amount was changed to $5.9\times10^{-5}$ mol per mol of the finished silver halide. Further, the amount of the 2% aqueous solution of RNA-F3 manufactured by NIPPON PAPER Chemicals CO., LTD. that was added after the completion of addition of the silver nitrate was change to 31.2 mL per mol of the finished silver halide. The addition amount of the sensitizing dye represented by the aforementioned S-4 was changed to $4.2\times10^{-4}$ mol per mol of silver halide; the addition amount of the sensitizing dye represented by the aforementioned S-5 was changed to $8.8\times10^{-5}$ mol per mol of silver halide; the addition amount of the sensitizing dye represented by the aforementioned S-6 was changed to $1.6\times10^{-5}$ mol per mol of silver halide; and the addition amount of the above-described Compound-4 was changed to $2.4\times10^{-4}$ mol per mol of silver halide. The thus-obtained emulsion grains were monodisperse cubic silver chlorobromide grains having a side length of 0.15 μm and a variation coefficient of 9.2%. This emulsion was re-dispersed by subjecting the emulsion to the deposition desalting treatment in the same manner as the Emulsion GH-1. The halogen composition (%) of the emulsion grains was Cl/Br/I=100/0/0.

To the emulsion thus re-dispersed, a sodium hydroxide aqueous solution was added and the pH value of the emulsion was adjusted to 5.30 at 40° C. Then, the emulsion was chemically sensitized by adding thereto sodium benzenethiosulfonate ($3.3\times10^{-5}$ mol per mol of silver halide), triethylthiourea ($1.8\times10^{-5}$ mol per mol of silver halide) as a sulfur sensitizer and chloroauric acid tetrahydrate ($1.5\times10^{-5}$ mol per mol of silver halide) as a gold sensitizer, and further by ripening them so that chemical sensitization was optimized. Then, the above-described Compound-6 ($2.2\times10^{-3}$ mol per mol of silver halide), 1-(5-methylureidophenyl)-5-mercaptotetrazole ($8.8\times10^{-4}$ mol per mol of silver halide), potassium bromide ($2.0\times10^{-2}$ mol per mol of silver halide), and the above-described Compound-7 ($1.9\times10^{-4}$ mol per mol of silver halide) were added to complete chemical sensitization. Finally, the above-described compound Ab-1 (0.59 g per kg of the chemically sensitized finished emulsion) and the above-described compound Ab-3 (0.5 g per kg of the chemically sensitized finished emulsion) were added. The thus-obtained emulsion was designated as Emulsion GM-1. The finished emulsion contains 90 g of silver halide in equivalent to metal silver, and 64 g of gelatin per kg of the finished emulsion.

(Preparation of Green-Sensitive Layer Emulsion GL-1)

High silver chloride cubic grains were prepared in the same manner as in the preparation of the Emulsion GH-1, except that the addition rate was changed in the step of simultaneously adding silver nitrate and sodium chloride and mixing them, and $K_2[IrCl_6]$ ($2.6\times10^{-7}$ mol per mol of the finished silver halide) was newly and continuously added over the step from 0% to 50% addition of the entire silver nitrate amount, and the amount of $K_2[IrCl_5$(5-methylthiazole)] continuously added over the step from 0% to 50% addition of the entire silver nitrate amount was changed to $1.1\times10^{-6}$ mol per mol of the finished silver halide, and the amount of $K_4[Fe(CN)_6]$ continuously added over the step from 50% to 100% addition of the entire silver nitrate amount was changed to $3.0\times10^{-5}$ mol per mol of the finished silver halide. Further, the amount of the 2% aqueous solution of RNA-F3 manufactured by NIPPON PAPER Chemicals CO., LTD. that was added after the completion of addition of the silver nitrate was change to 33.8 mL per mol of the finished silver halide. Further, the addition amount of the sensitizing dye represented by the above-described S-4 was changed to $4.4\times10^{-4}$ mol per mol of silver halide; the addition amount of the sensitizing dye represented by the aforementioned S-5 was changed to $9.4\times10^{-5}$ mol per mol of silver halide; the addition amount of the sensitizing dye represented by the aforementioned S-6 was changed to $1.7\times10^{-5}$ mol per mol of silver halide; and the addition amount of the above-described Compound-4 was changed to $6.5\times10^{-4}$ mol per mol of silver halide. The thus-obtained emulsion grains were monodisperse cubic silver chlorobromide grains having a side length of 0.12 μm and a variation coefficient of 13.2%. This emulsion was re-dispersed by subjecting the emulsion to the deposition desalting treatment in the same manner as the Emulsion GH-1. The halogen composition (%) of the emulsion grains was Cl/Br/I=100/0/0.

To the emulsion thus re-dispersed, a sodium hydroxide aqueous solution was added and the pH value of the emulsion was adjusted to 5.30 at 40° C. Then, the emulsion was chemically sensitized by adding thereto sodium benzenethiosulfonate ($3.9\times10^{-5}$ mol per mol of silver halide), triethylthiourea ($2.4\times10^{-5}$ mol per mol of silver halide) as a sulfur sensitizer and chloroauric acid tetrahydrate ($1.8\times10^{-5}$ mol per mol of silver halide) as a gold sensitizer, and further by ripening them so that chemical sensitization was optimized. Then, the above-described Compound-6 ($2.7\times10^{-3}$ mol per mol of silver halide), 1-(5-methylureidophenyl)-5-mercaptotetrazole ($1.1\times10^{-3}$ mol per mol of silver halide), potassium bromide ($2.5\times10^{-2}$ mol per mol of silver halide), and the above-described Compound-7 ($2.4\times10^{-4}$ mol per mol of silver halide) were added to complete chemical sensitization. Finally, the above-described compound Ab-1 (0.56 g per kg of the chemically sensitized finished emulsion) and the above-described compound Ab-3 (0.5 g per kg of the chemically sensitized finished emulsion) were added. The thus-obtained emulsion was designated as Emulsion GL-1. The finished emulsion contains 85 g of silver halide in equivalent to metal silver, and 60 g of gelatin per kg of the finished emulsion.

[Preparation of Solid Fine-Particle Dispersions of Dyes]

A methanol wet cake of the following compound (D-1) was weighed such that the net amount of the compound was 240 g, and 48 g of the following compound (Pm-1) as a dispersing aid was weighed. To the compounds was added water such that the total amount was 4,000 g. The mixture was crushed at a discharge rate of 0.5 L/minute and a peripheral velocity of 10 m/s for 2 hours by using "a flow system sand grinder mill (UVM-2)" (trade name, manufactured by AIMEX K.K.) filled with 1.7 L of zirconia beads (diameter: 0.5 mm). Then, the dispersion was diluted such that the concentration of the compound was 3 mass %, and Compound (Pm-1) represented by the following structural formula was added in an amount of 3% in terms of mass ratio to the dye (this dispersion is referred to as Dispersion A). The average particle size of this dispersion was 0.45 μm.

Further, a dispersion, which contained 5 mass % of the following compound (D-2), was prepared in the same manner as above (this is referred to as Dispersion B).

Pm-1

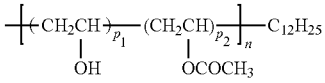

$p_1$ = 88 mol %
$p_2$ = 12 mol %
Polymerization degree 300

D-1

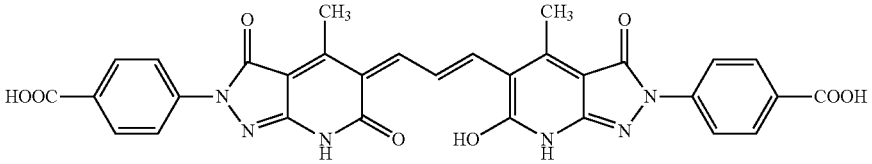

-continued

D2

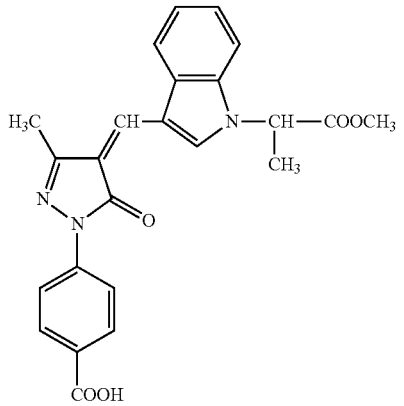

—Preparation of a Coating Solution for a Second Layer—

72.2 g of a yellow coupler (ExY'), 0.02 g of an additive (Cpd-44), 0.5 g of an additive (Cpd-45), 0.2 g of an additive (Cpd-46), 0.4 g of an additive (Cpd-57) and 1.0 g of the following compound (SR-2) were dissolved in a mixture of 29 mL of solvent (Solv-21), 3 g of solvent (Solv-24) and 150 mL of ethyl acetate. The solution was emulsified and dispersed in 1,000 g of an aqueous 10% gelatin solution containing 18 mL of 20% solution of the following compound (SR-1), to prepare an emulsified dispersion Y. On the other hand, using the above-mentioned silver chlorobromide emulsions BH-1, BM-1 and BL-1, the above emulsified dispersion Y and the silver chlorobromide emulsions were mixed and dissolved, to prepare a coating solution for a second layer such that the solution had the following composition. Coating solutions for a first layer and third to seventh layers were also prepared in the same manner as the coating solution for a second layer.

SR-1

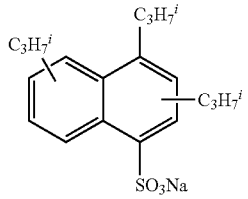

SR-2

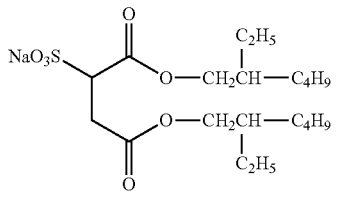

—Layer Constitution—

The composition of each of the layers is shown below. The numerals show the respective amounts (g/m$^2$) to be applied. As the addition amount of the silver halide emulsion, an amount converted into that of silver is shown. As a gelatin hardener, a sodium salt of 1-oxy-3,5-dichloro-s-triazine was used.

First Layer (Halation Preventive Layer (Non-Light-Sensitive Hydrophilic Colloid Layer))

| | |
|---|---|
| Gelatin | 1.96 |
| The above Dispersion A (in terms of coating amount of dye) | 0.10 |
| The above Dispersion B (in terms of coating amount of dye) | 0.06 |

Second Layer (Blue Light-Sensitive Silver Halide Emulsion Layer)

| | |
|---|---|
| A mixture of the emulsion BH-1, the emulsion BH-1 and the emulsion BL-1, mixed in a ratio of 10:15:75 (mol ratio of silver) | 0.45 |
| Gelatin | 3.26 |
| Yellow coupler (ExY') | 1.07 |
| (Cpd-41) | 0.0006 |
| (Cpd-42) | 0.005 |
| (Cpd-44) | 0.0003 |
| (Cpd-45) | 0.008 |
| (Cpd-46) | 0.003 |
| (Cpd-57) | 0.005 |
| (Cpd-65) | 0.005 |
| (SR-1) | 0.06 |
| (SR-2) | 0.02 |
| Solvent (Solv-21) | 0.50 |
| Solvent (Solv-24) | 0.04 |

Third Layer (Color-Mixing Inhibiting Layer)

| | |
|---|---|
| Gelatin | 0.69 |
| (Cpd-49) | 0.02 |
| (Cpd-43) | 0.05 |
| (Cpd-53) | 0.006 |
| (Cpd-62) | 0.06 |
| (Cpd-64) | 0.009 |
| (SR-1) | 0.008 |
| Solvent (Solv-21) | 0.07 |
| Solvent (Solv-23) | 0.05 |
| Solvent (Solv-24) | 0.002 |

Fourth Layer (Red Light-Sensitive Silver Halide Emulsion Layer)

| | |
|---|---|
| A mixture of the emulsion RH-1, the emulsion RM-1 and the emulsion RL-1, mixed in a ratio of 10:30:60 (mol ratio of silver) | 0.35 |

-continued

| | |
|---|---|
| Gelatin | 2.90 |
| Cyan coupler (ExC') | 0.81 |
| (Cpd-47) | 0.10 |
| (Cpd-48) | 0.06 |
| (Cpd-50) | 0.03 |
| (Cpd-51) | 0.04 |
| (Cpd-53) | 0.02 |
| (Cpd-54) | 0.08 |
| (Cpd-57) | 0.01 |
| (Cpd-58) | 0.0007 |
| (Cpd-60) | 0.02 |
| Sodium chloride | 0.03 |
| (SR-1) | 0.03 |
| (SR-2) | 0.03 |
| Solvent (Solv-21) | 0.53 |
| Solvent (Solv-22) | 0.30 |
| Solvent (Solv-23) | 0.03 |

Fifth Layer (Color-Mixing Inhibiting Layer)

| | |
|---|---|
| Gelatin | 0.53 |
| (Cpd-49) | 0.02 |
| (Cpd-43) | 0.04 |
| (Cpd-53) | 0.004 |
| (Cpd-61) | 0.007 |
| (Cpd-62) | 0.04 |
| (Cpd-63) | 0.003 |
| (SR-1) | 0.006 |
| Solvent (Solv-21) | 0.05 |
| Solvent (Solv-23) | 0.04 |
| Solvent (Solv-24) | 0.002 |

Sixth Layer (Green Light-Sensitive Silver Halide Emulsion Layer)

| | |
|---|---|
| A mixture of the emulsion GH-1, the emulsion GM-1 and the emulsion GL-1, mixed in a ratio of 15:30:55 (mol ratio of silver) | 0.47 |
| Gelatin | 1.65 |
| Magenta coupler (ExM') | 0.72 |
| (Cpd-49) | 0.013 |
| (Cpd-52) | 0.001 |
| (Cpd-58) | 0.002 |
| Sodium chloride | 0.04 |
| (SR-1) | 0.01 |
| (SR-2) | 0.03 |
| Solvent (Solv-21) | 0.13 |

Seventh Layer (Emulsion-Protective Layer)

| | |
|---|---|
| Gelatin | 0.94 |
| Acrylic resin (average particle diameter, 2 μm) | 0.002 |
| (Cpd-55) | 0.0007 |
| (Cpd-56) | 0.08 |
| (SR-2) | 0.03 |

Hereinafter, the compounds used are shown.

ExY'

(1)

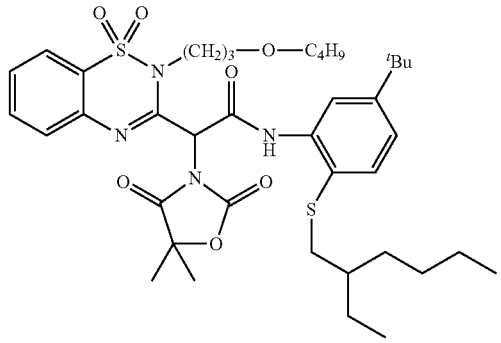

(2)

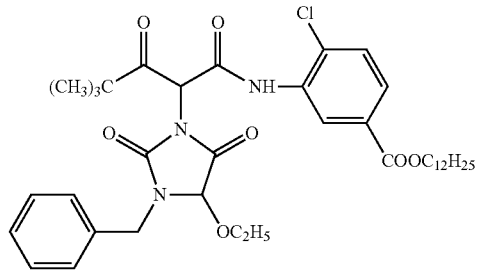

(3)

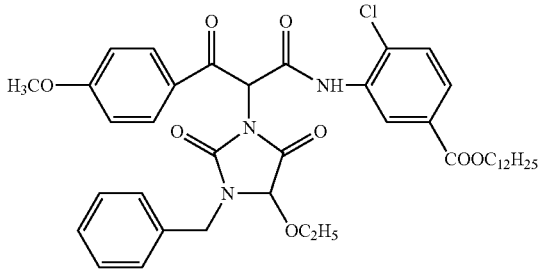

A mixture in 75:5:20 (molar ratio) of (1), (2), and (3)

ExC'

(1)

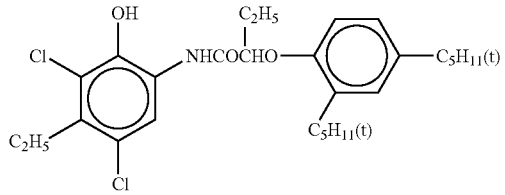

(2)

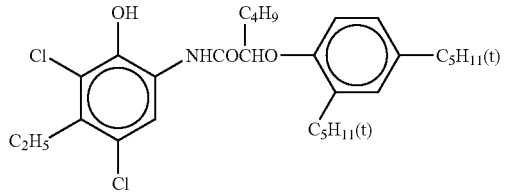

-continued
(3)
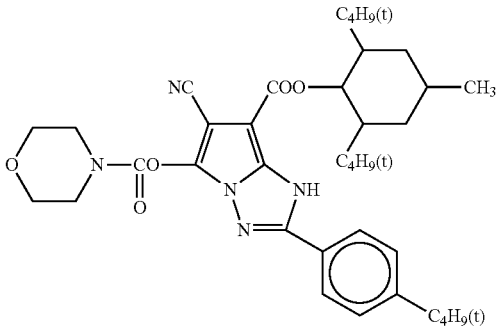
(4)
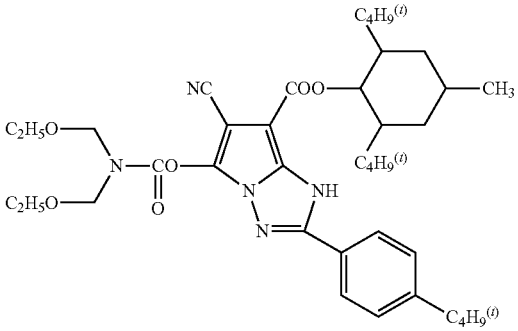
A mixture in 40:40:10:10 (molar ratio) of (1), (2), (3), and (4)
ExM′
(1)
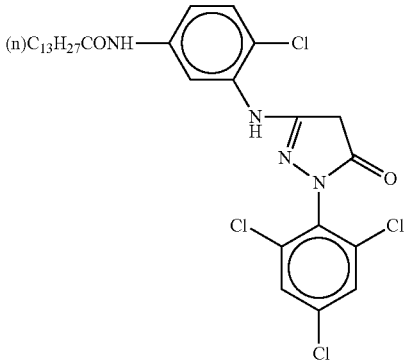
(2)
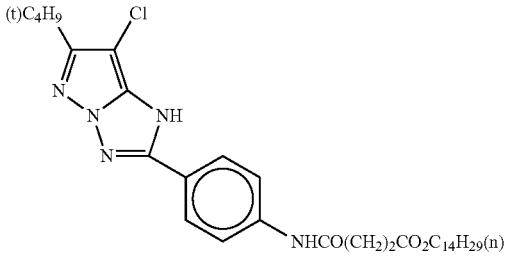
-continued
(3)
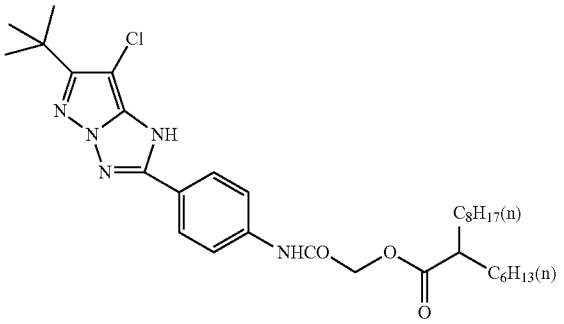
A mixture in 90:5:5 (molar ratio) of (1), (2), and (3)
(Cpd-41)
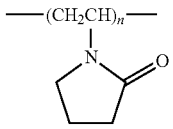
(Cpd-42)
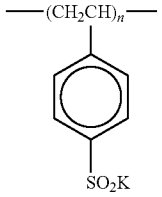
(Cpd-43)
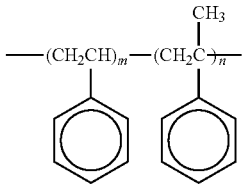
Number-average molecular weight 600
m/n = 10/90
(Cpd-44)
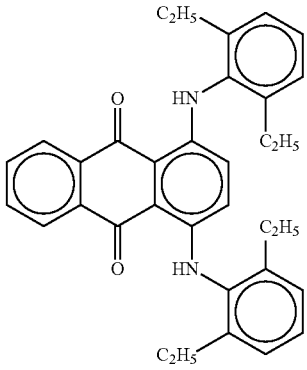

-continued
(Cpd-45)
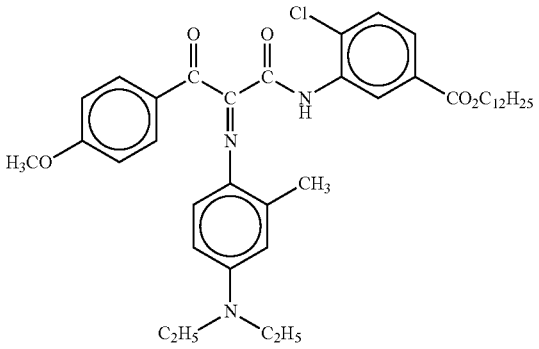
(Cpd-46)
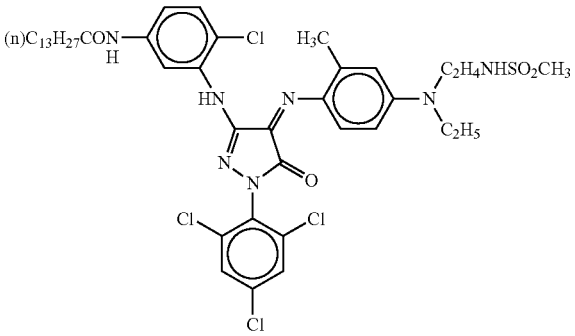
(Cpd-47)
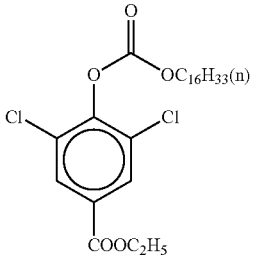
(Cpd-48)
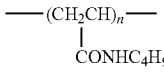
Average molecular weight
about 60,000
(Cpd-49)
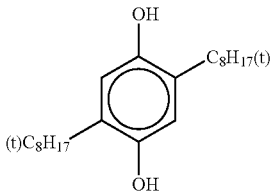
(Cpd-50)
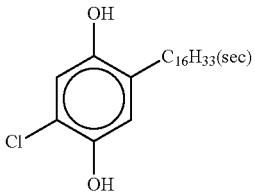
-continued
(Cpd-51)
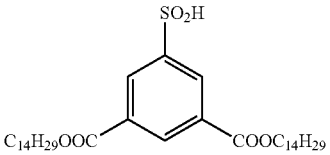
(Cpd-52)
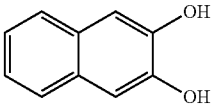
(Cpd-53)
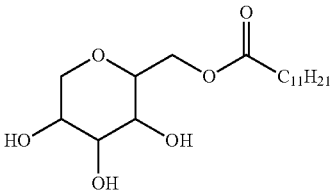
(Cpd-54)
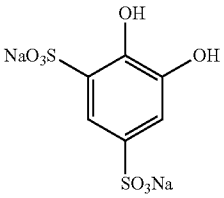
(Cpd-55)
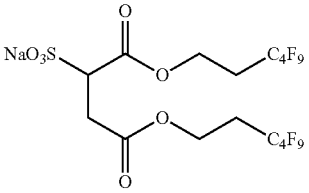
(Cpd-56)
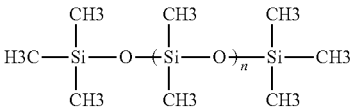
(Cpd-57)
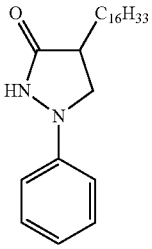
(Cpd-58)
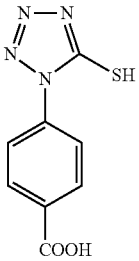

-continued (Cpd-59)

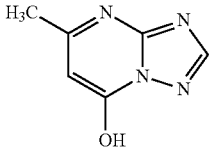

(Cpd-60)

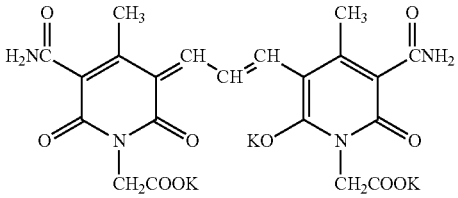

(Cpd-61)

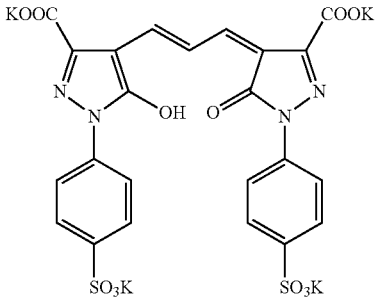

(Cpd-62)

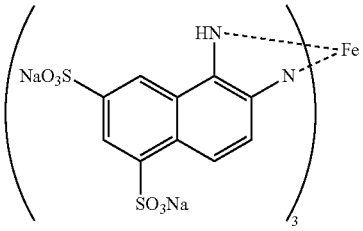

(Cpd-63)

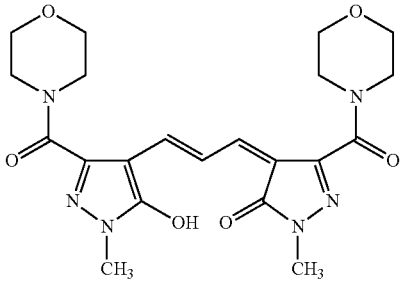

(Cpd-64)

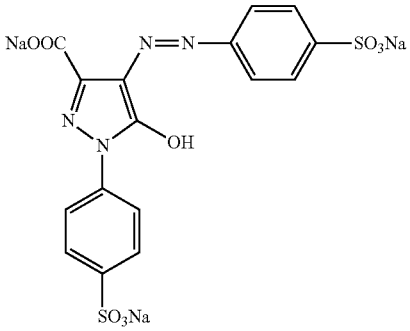

-continued (Cpd-65)

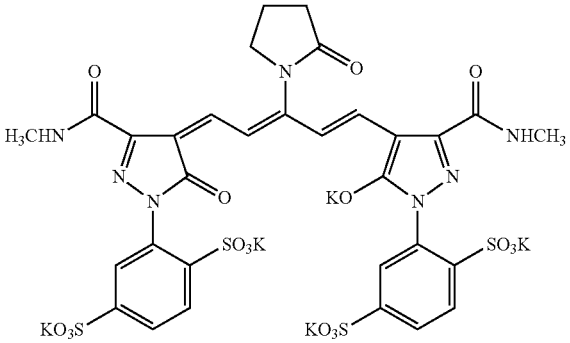

(Solv-21)

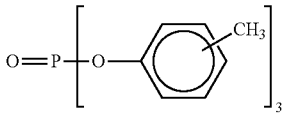

(Solv-22)

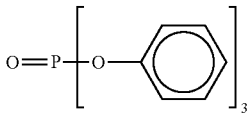

(Solv-23)

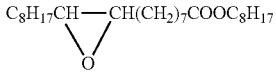

(Solv-24)

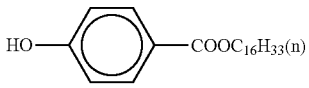

In the above manner, Sample 101 was prepared.

<Preparation of Samples 102 to 108>

Next, tin oxide-antimony oxide dispersion TDL-1 contained in the first undercoating layer provided on the back side of the support in the preparation of the above-described sample 101, Orgacon HBS of polyethylenedioxythiophene/polystyrenesulfonic acid electroconductive polymer dispersion, and the following Compound (5) were used, and coating layers containing them and layers of which coating amounts shown in the following Table 3 were applied, thereby to form samples 102 to 108. In addition, the coating amount refers to "part by mass" in the coating liquid. In Table 3, the coating amount is described in parentheses.

Compound (5)

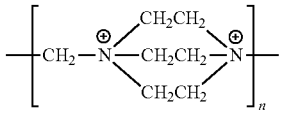

<Test and Evaluation>

Tests and evaluations of the above-described samples 101 to 108 were conducted, as shown below, in order to evaluate electrostatic chargeability (evaluations in terms of generation of static marks, flat platter transport test, and occurrence of dust-adhesion).

—Evaluation Electrostatic Chargeability—

The obtained samples 101 to 108 were evaluated, as described below, in terms of the generation of static marks, generation of an adhesion by static electricity in a flat platter projector, and the occurrence of dust-adhesion.

(1) Generation of Static Marks

Each of the samples was worked into a long film having a width of 35 mm, and was exposed to light so as to set the value of density, measured by X-rite 340 (trade name, manufactured by X-Rite, Incorporated) after standard processing, to be (R, G, B)=(1.0, 1.0, 1.0). Under the condition of 25° C. and relative humidity of 20%, each of the samples was transported by means of a printer at a rate of 2,500 ft/minute (762 m/minute) in a dark room, and then was subjected to ECP-2D processing by an automatic processing device. Each of the resulting samples was observed with naked eyes and evaluated based on the following criteria.

○: No static mark was generated.

Δ: Static marks were generated in some portions.

x: Many static marks were generated.

xx: Static marks were continuously generated to form a linear mark.

(2) Occurrence of an Adhesion by Static Electricity in a Flat Platter Projector 6,000 ft (1,828.8 m) of each of the processed samples were transported by means of the flat platter projector (trade name: LP-270, manufactured by SPECO Systems & Products Engineering Company), and then each of the samples was evaluated based on the following criteria.

○: There was no adhesion.

Δ: The film was sometime transported in a state that portions thereof adhered to each other.

x: The film was frequently transported in a state that portions thereof adhered to each other.

xx: The film was transported in a state that portions thereof adhered to each other and the film clung onto the center of the platter.

(3) Occurrence of Dust-Adhesion in the Flat Platter Cine Projector 2,000 ft (609.6 m) of each of the processed samples described above was transported 10 times under the conditions of 25° C. and 30% RH using a cine projector (trade name: FCX-1000, manufactured by CINEFORWARD). Each of the screenings was evaluated with naked eyes as described below.

○: There was no dust.

Δ: Dust was sometimes displayed on the screen.

x: Dust was frequently displayed on the screen.

xx: Dust was very frequently displayed on the screen.

—Measurement of Electrical Resistance Value—

Electrical resistance values of the obtained samples 101 to 108 were measured as described below according to the method of measuring resistivities described in JIS-K-6911-1979. Each of the light-sensitive materials was subjected to a humidity conditioning for 6 hours under the atmospheres of 25° C. and 10% RH. Thereafter, the electrical resistance values were measured under the same environments using a digital ultrahigh resistance/minute electric current meter (trade name: 8340A, manufactured by ADC CORPORATION (ADCMT)) and a resistivity chamber (trade name: 12704A, manufactured by ADC CORPORATION).

In addition, only layers respectively corresponding to the electroconductive layers of each of the samples were respectively coated on the above-described support in the form of a single layer, thereby to prepare samples in which the corresponding electroconductive layer was applied. Electric resistivities SR1 and SR2 were measured, in which SR1 was a resistivity of the layer having the lowest electric resistivity among the layers of the samples before ECP-2D development treatment and SR2 was a resistivity of the layer having the lowest electric resistivity among the layers of the samples after ECP-2D processing. Further, by subjecting each of the single layer samples to the processing shown in the above-described Table 2, common logarithm of electrical resistivity SR 3 of the layer having the lowest electric resistivity was measured.

—Measurement of Metal Ion Amount in Film—

Measurement of an element content of the obtained samples 101 to 108 was performed with respect to 1 $cm^2$ of each of the samples using HR-ICP-MS (ATTOM high-resolution type ICP mass spectrometer manufactured by Seiko Instrument Inc. (SII)).

Samples (in which the undercoating layer on the side of the silver halide emulsion layer, the undercoating layer at the back side of the support, and the protective layer on were provided), respectively corresponding to the samples 101 to 108, were prepared in the same manner in each of the samples 101 to 108, except that the first layer (halation preventive layer) and the other layers on or above the first layer were not provided. With respect to all of the undercoating layers or all of the undercoating layers and the protective layer at the side of the electroconductive polymer-introduced electroconductive layer, a total content of metal ions consisting of $Na^+$, $K^+$, $Ca^{2+}$ and $Mg^{2+}$ in the above-described layers was measured. The results of measurement are shown in the column "Metal ion content of electroconductive polymer-introduced electroconductive layer side" of the following Table 3.

TABLE 3-1

| Sample No. | Silver halide emulsion layer | Second undercoating layer at silver halide emulsion layer side | First undercoating layer at silver halide emulsion layer side | First undercoating layer at back side | Protective layer at back side | Metal ion content of electroconductive polymer-introduced electroconductive layer side [mg/$m^2$] |
|---|---|---|---|---|---|---|
| 101 (This invention) | Provided | — | — | TDL-1 (9.1) | Orgacon HBS (3.6) | 0.2 |
| 102 (This invention) | Provided | — | TDL-1 (9.1) | — | Orgacon HBS (3.6) | 0.2 |
| 103 (This invention) | Provided | — | TDL-1 (9.1) | Orgacon HBS (3.6) | — | 0.3 |
| 104 (This invention) | Provided | — | Orgacon HBS (7.2) | TDL-1 (9.1) | — | 3.0 |
| 105 (Comparative example) | Provided | — | — | TDL-1 (7.1) Compound (5) (2.0) | — | 0.9 |
| 106 (Comparative example) | Provided | — | — | TDL-1 (9.1) | — | No conductive polymer was introduced. |
| 107 (Comparative example) | Provided | — | — | TDL-1 (7.1) | — | No conductive polymer was introduced. |
| 108 (Comparative example) | Provided | — | — | Orgacon HBS (3.6) | — | 0.3 |

TABLE 3-2

| Sample No. | Static mark | Occurrence of adhesion by static electricity in flat platter projector | Dust-adhesion | SR1 [Ω/□] | SR2 [Ω/□] | SR3 [Ω/□] | SR3 − SR2 [Ω/□] |
|---|---|---|---|---|---|---|---|
| 101 (This invention) | ○ | ○ | ○ | 8.3 | 10.0 | 10.0 | 0.0 |
| 102 (This invention) | ○ | ○ | ○ | 8.3 | 10.0 | 10.0 | 0.0 |
| 103 (This invention) | ○ | ○ | ○ | 8.3 | 10.0 | 10.0 | 0.0 |
| 104 (This invention) | ○ | ○ | ○ | 8.5 | 8.5 | 9.0 | 0.5 |
| 105 (Comparative example) | x | ○ | Δ | 11.2 | 11.0 | 11.1 | 0.1 |
| 106 (Comparative example) | x | ○ | ○ | 10.2 | 9.9 | 9.8 | −0.1 |
| 107 (Comparative example) | x | ○ | Δ | 11.2 | 11.0 | 11.1 | 0.1 |
| 108 (Comparative example) | ○ | Δ | ○ | 8.3 | 9.2 | 8.5 | −0.7 |

As is apparent from Tables 3-1 and 3-2, in the comparative samples 105 to 108 as previous ones, it was difficult to achieve reduction in the generation of static marks, the occurrence of an adhesion by static electricity in the flat platter projector, and the generation of dust-adhesion in the projector at the same time. In contrast, the generation of static marks, the occurrence of an adhesion by static electricity in the flat platter projector, and the generation of dust-adhesion in the projector were suppressed at the same time in each of the samples according to the present invention (samples 101 to 104). In addition, in the case of singly using electroconductive metal oxide particles as in the comparative examples 106 and 107, generation of static marks was caused at the time of high-speed printing. As in the comparative sample 105, generation of static marks was not improved even though the electroconductive metal oxide particles were used in combination with the Compound (5). In addition, the comparative samples 107 and 105, each of which contains a reduced amount of electroconductive metal oxide particles, without satisfying any of Expression (A) and Expression (B), resulted in generation of static marks and generation of dust-adhesion in the projector. In addition, in the case of singly using the electroconductive polymer as in the comparative sample 108, the value of |SR3−SR2| exceeded the upper limit and then fluctuation in electroconductive properties became large when a color processing time was shortened.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2010-107762 filed in Japan on May 7, 2010, which is entirely herein incorporated by reference.

What we claim is:

1. A silver halide photographic light-sensitive material for movie, comprising:

a transmissive support:

at least one silver halide emulsion layer;

at least one undercoating layer provided between the support and the silver halide emulsion layer closest to the support; and at least one undercoating layer and a protective layer provided at the back side of the support (namely, at the other side of the support which is opposite to the side at which the silver halide emulsion layer is provided), wherein any of the layers selected from the at least one undercoating layer at the side of silver halide emulsion layer, said at least one undercoating layer at the back side of the support and the protective layer at the back side of the support contains either or both of (a) particles of at least one electrically-conductive metal oxide and (b) at least one electroconductive polymer, and wherein, (i) the layer containing said particles of at least one electroconductive metal oxide is different from the layer containing said at least one electroconductive polymer, or (ii) said particles of at least one electroconductive metal oxide and said at least one electroconductive polymer are contained in the same layer other than the undercoating layer that is contacted with the back side of the support.

2. The silver halide photographic light-sensitive material for movie according to claim 1, wherein, (i) said particles of at least one electroconductive metal oxide and said at least one electrically-conductive polymer are contained, respectively, in different layers selected from said at least one undercoating layer at the back side of the support and the protective layer at the back side of the support, or (ii) one of (a) said particles of at least one electroconductive metal oxide and (b) said at least one electroconductive polymer is contained in said at least one undercoating layer at the side having the silver halide emulsion layer and the other of (a) said particles of at least one electroconductive metal oxide and (b) said at least one electroconductive polymer is contained in said at least one undercoating layer at the back side of the support or the protective layer at the back side of the support.

3. The silver halide photographic light-sensitive material for movie according to claim 1, wherein said particles of at least one electroconductive metal oxide and said at least one electroconductive polymer are contained in different layers selected from said at least one undercoating layer at the back side of the support and the protective layer at the back side of the support.

4. The silver halide photographic light-sensitive material for movie according to claim 1, wherein said at least one electroconductive polymer is an electroconductive polymer selected from the group consisting of polythiophene, polyaniline, polypyrrole, and a complex thereof.

5. The silver halide photographic light-sensitive material for movie according to claim 1, wherein said particles of at least one electroconductive metal oxide is an oxide metal selected from the group consisting of ZnO, $TiO_2$, $SnO_2$, $Al_2O_3$, $In_2O_3$, MgO, a complex metal oxide of these metal oxides, and a metal oxide containing at least one of these metal oxides and a different atom.

6. The silver halide photographic light-sensitive material for movie according claim 1, wherein a total amount of metal ions consisting of $Na^+$, $K^+$, $Ca^{2+}$ and $Mg^{2+}$ contained in all of the undercoating layer and the protective layer at the side of the support at which the layer containing the electroconductive polymer is provided is 0.5 mg/$m^2$ or less.

7. The silver halide photographic light-sensitive material for movie according to claim 1, wherein a total film thickness of said at least one undercoating layer at the back side of the support and the protective layer at the back side of the support is in a range from 0.02 μm to 1 μm.

8. The silver halide photographic light-sensitive material for movie according to claim 1, wherein the silver halide photographic light-sensitive material for movie has at least one yellow color-developable light-sensitive silver halide emulsion layer, at least one cyan color-developable light-sensitive silver halide emulsion layer, and at least one magenta color-developable light-sensitive silver halide emulsion layer on or above the support, and wherein the support is a polyester support.

9. The silver halide photographic light-sensitive material for movie according to claim 1, wherein electrical resistivities before and after processing of the silver halide photographic light-sensitive material for movie satisfy the relations of the following Expression (A) and Expression (B) at the same time:

$$SR1<9.0 \quad \text{Expression (A)}$$

$$9.5 \leqq SR2 \leqq 10.5 \quad \text{Expression (B)}$$

wherein, in Expression (A) and Expression (B), SR1 represents a common logarithm of electrical resistivity of the layer having the lowest electrical resistivity among layers containing said particles of at least one electroconductive metal oxide or said at least one electroconductive polymer before a processing of the silver halide photographic light-sensitive material for movie; and SR2 represents a common logarithm of electrical resistivity of the layer having the lowest electrical resistivity among layers containing said particles of at least one electroconductive metal oxide or said at least one electroconductive polymer after subjecting the silver halide photographic light-sensitive material for movie to a processing in which a processing time at the step of color development is set to be 3 minutes.

10. The silver halide photographic light-sensitive material for movie according to claim 1, wherein the common logarithms of the electrical resistivity of the silver halide photographic light-sensitive material for movie satisfy the relation of the following Expression (C):

$$|SR3-SR2| \leqq 0.3 \quad \text{Expression (C)}$$

wherein, in Expression (C), SR2 has the same meaning as that of SR2 defined in claim 9; and SR3 represents a common logarithm of electrical resistivity of the layer having the lowest electrical resistivity among layers containing said particles of at least one electroconductive metal oxide or said at least one electroconductive polymer after subjecting the silver halide photographic light-sensitive material for movie to a processing in which a processing time at the step of color development is set to be 1 minute.

11. The silver halide photographic light-sensitive material for movie according claim 2, wherein said particles of at least one electroconductive metal oxide are contained in said at least one undercoating layer at the side of silver halide emulsion layer, and wherein said at least one electroconductive polymer are contained in said at least one undercoating layer at the back side of the support or the protective layer at the back side of the support.

12. The silver halide photographic light-sensitive material for movie according to claim 2, wherein said particles of at least one electroconductive metal oxide are contained in said at least one undercoating layer at the back side of the support or the protective layer at the back side of the support, and wherein said at least one electroconductive polymer are contained in said at least one undercoating layer at the side of silver halide emulsion layer.

13. The silver halide photographic light-sensitive material for movie according to claim 3, wherein said particles of at least one electroconductive metal oxide are contained in said at least one undercoating layer at the back side of the support, and wherein said at least one electroconductive polymer are contained in the protective layer at the back side of the support.

14. The silver halide photographic light-sensitive material for movie according to claim 3, wherein said particles of at least one electroconductive metal oxide are contained in the protective layer at the back side of the support, and wherein said at least one electroconductive polymer are contained in said at least one undercoating layer at the back side of the support.

* * * * *